United States Patent [19]

Morita et al.

[11] Patent Number: 4,543,934

[45] Date of Patent: Oct. 1, 1985

[54] AIR/FUEL RATIO CONTROL SYSTEM FOR INTERNAL COMBUSTION ENGINE AND METHOD THEREFOR

[75] Inventors: Tatsuo Morita; Kunifumi Sawamoto, both of Yokosuka, Japan

[73] Assignee: Nissan Motor Company, Limited, Yokohama, Japan

[21] Appl. No.: 562,089

[22] Filed: Dec. 16, 1983

[30] Foreign Application Priority Data

Jan. 10, 1983 [JP] Japan ..... 58-1145
Dec. 21, 1983 [JP] Japan ..... 57-222847

[51] Int. Cl.[4] ..... F02M 51/00
[52] U.S. Cl. ..... 123/435; 123/436
[58] Field of Search ..... 123/435, 436, 478

[56] References Cited

U.S. PATENT DOCUMENTS

| | | | |
|---|---|---|---|
| 3,789,816 | 2/1974 | Taplin et al. | 123/478 X |
| 4,161,162 | 7/1979 | Latsch et al. | 123/435 |
| 4,197,767 | 4/1980 | Leung | 123/179 G X |
| 4,216,750 | 8/1980 | Kobayashi | 123/435 |
| 4,391,248 | 7/1983 | Latsch | 123/435 X |

OTHER PUBLICATIONS

Society of Automotive Engineers, "Effects of Swirl and Squish on S.I. Engine Combustion and Emission", pp. 1–10, Feb. 28–Mar. 4, 1977.

*Primary Examiner*—Tony M. Argenbright
*Attorney, Agent, or Firm*—Schwartz, Jeffery, Schwaab, Mack, Blumenthal & Evans

[57] ABSTRACT

An air/fuel ratio control system is applicable to lean mixture combustion internal combustion engines. The control system determines the value of the mixture ratio at which engine stability can switch between stable and unstable conditions. As long as the engine continues to run in a stable condition in which the engine roughness is within an acceptable range, the mixture is intermittently leaned out by a given proportion. On the other hand, when engine roughness in an unacceptable range is detected, the mixture ratio is enriched by a given proportion to overcome the unacceptable engine roughness. Enrichment of the mixture is continued until engine roughness within the acceptable range is detected.

54 Claims, 32 Drawing Figures

FIG.24

SAMPLE REGISTER

| | | | | |
|---|---|---|---|---|
| $\Theta_1$ | $\Theta_2$ | $\Theta_3$ | | $\Theta_{15}$ |
| $\Theta_{16}$ | $\Theta_{17}$ | $\Theta_{18}$ | | $\Theta_{30}$ |
| $\Theta_{31}$ | | | | |
| $\Theta_{46}$ | $\Theta_{47}$ | | | $\Theta_{60}$ |

FIG.25

REGISTER n1

| | | | |
|---|---|---|---|
| #1 | #2 | #3 | #4 |

AIR/FUEL RATIO CONTROL SYSTEM FOR INTERNAL COMBUSTION ENGINE AND METHOD THEREFOR

BACKGROUND OF THE INVENTION

The present invention relates generally to an air/fuel ratio control system for an internal combustion engine. More particularly, the invention relates to an air/fuel ratio control system for lean-mixture combustion in an internal combustion engine while maintaining engine fluctuations within a predetermined allowable range.

In recent years, lean-mixture combustion has been considered to be good for fuel economy in an internal combustion engine. As less fuel is consumed in each cycle of engine revolution, it is apparent that lean-mixture combustion in the engine will save fuel and provide better fuel economy. On the other hand, lean-mixture combustion has been considered to increase engine roughness and cycle-to-cycle fluctuations in engine revolution. This may degrade engine preformance and drivability.

When the engine running condition is out of the predetermined allowable range, and thus the engine is running in an unstable manner, such unstable conditions may be recognized by checking for variations in the crank shaft angular positions at which the pressure within an engine cylinder is maximized. In general, the crankshaft angular position corresponding to the minimum advance for best torque (MBT) remains constant or at least within a fixed fluctuation range when the engine is running smoothly. On the other hand, when the engine is running unstably or roughly, a variation of the crankshaft angular position at which the internal pressure in the combustion chamber is maximized becomes significant. Therefore, if variation of the crankshaft angular position at which the maximum internal pressure is obtained exceeds a predetermined allowable range, engine roughness or instability can be recognized.

SAE Paper No. 770,217, Feb. 28-Mar. 4, 1977, written by Isao NAGAYAMA, Yasushi ARAKI and Yasuo IIOKA discusses vehicle driveability with reference to FIG. 9 thereof. In the disclosure of this SAE Paper, the driveability limit was set to the point where the driver judged subjectively that the level of vehicle surge produced was unacceptable. The observed relationship between cycle-to-cycle fluctuation of I.M.E.P. and vehicle surge level is shown in FIG. 9 of the SAE Paper. In the test vehicle, especially when it was in third gear, the region of torque fluctuation rate greater than 50% and cycle-to-cycle fluctuation rate greater than 10% exhibitted unacceptable levels of vehicle surge. To aid understanding of the required stability of the engine and, in turn, of roughness of the engine, the disclosure of SAE Paper No. 770217 is hereby incorporated by reference.

As will be appreciated, by making the air/fuel mixture leaner, the cycle-to-cycle fluctuation rate as well as the torque fluctuation rate is increased causing the engine to run roughly. To cure the engine roughness, the air/fuel ratio is controlled to supply a richer mixture. As will be appreciated herefrom, in a lean mixture combustion system, it is essential to detect the engine roughness to perform enrichment in order to prevent the engine from falling into seriously rough operation.

SUMMARY OF THE INVENTION

Therefore, it is an object of the present invention to provide an air/fuel ratio control system for an internal combustion engine, which control system allows combustion of a leaner mixture and can maintain the engine stability within an allowable range.

Another and more specific object of the present invention is to provide an air/fuel ratio control system which detects engine roughness based on the variation of the crankshaft angular position at which maximum internal pressure in the combustion engine is obtained or at which the engine output torque peak is obtained, to perform enrichment of the air/fuel mixture when the detected variation exceeds preset acceptable limits and otherwise to make the mixture ratio leaner as long as the engine continues to run stably.

A further object of the invention is to provide an air/fuel ratio control system which precisely controls the air/fuel ratio at the border between stable and unstable engine operation in order to minimize fuel consumption.

According to the present invention, an air/fuel ratio control system is provided with a pressure sensor adapted to detect the internal pressure in a corresponding engine cylinder, and a crank angle sensor. A controller is adapted to detect the peak value of the pressure sensor output and the corresponding crankshaft angular position. The detected crankshaft angular position is compared with given lower and upper thresholds which define a predetermined normal angular range. If the detected crankshaft angular position is occasionally out of the normal angular range, the occurrences of such combustion in which the maximum internal pressure is obtained at a crankshaft angular position outside of the normal angle range are counted. When the counter value exceeds a predetermined value, then the air/fuel ratio is controlled to supply a richer mixture in order to prevent the engine from operating roughly.

In the preferred embodiment, the number of engine cylinders in which the maximum combustion pressure at the crankshaft angular position out of the normal range occurs is counted. When the counted number of cylinders exceeds a given number, then enrichment of the air/fuel mixture is performed. On the other hand, as long as the crankshaft angular positions at which the maximum pressures in the combustion chambers are obtained, remain within the normal angle range, the mixture is made leaner at a predetermined rate until engine roughness is detected in the foregoing manner.

In one aspect of the invention, an air/fuel ratio control system for an internal combustion engine comprises a first detector for detecting engine operating conditions to produce an engine operating condition indicative signal representative of a basic fuel delivery parameter, a second detector for detecting cycle-to-cycle fluctuations of the output of each of the engine cylinders to produce a detector signal when the engine fluctuation rate is outside of a given allowable range, a counter means for counting occurrences of the non-allowable engine fluctuations in each engine cylinder and outputting a first counter signal representative of the number of engine cylinders in which non-allowable engine fluctuations are detected, and a controller unit responsive to the engine operating condition indicative signal for deriving a fuel delivery amount based thereon, and deriving an air/fuel ratio which varies in the direction of a leaner mixture at a first given rate as long as the first counter signal value remains less than a given threshold and in the direction of a richer mixture at a second given rate when the first counter signal value is equal to or greater than the given threshold.

According to the present invention, there is further provided a method for controlling the air/fuel ratio for lean mixture combustion in which cycle-to-cycle fluctuations in combustion pressure in each cylinder are detected and checked to see if they are within a predetermined acceptable range. Detection of the cycle-to-cycle fluctuations is made by detecting the variation of the crankshaft angular position at which the maximum pressures within each engine cylinder are obtained. The variation magnitude and/or the detected crankshaft angular position is checked to see if it is in a predetermined range. When an unacceptable range of fluctuation is detected, the occurrences thereof for each cylinder are counted. The total occurrence and number of the cylinders in which unacceptable fluctuations occur are checked in order to monitor the roughness of the engine. When the engine is judged to be running roughly, enrichment of the air/fuel ratio is carried out in order to keep the engine running smoothly.

In one aspect of the invention, a method for controlling the air/fuel ratio comprises the steps of: detecting engine operating conditions to derive a fuel delivery amount depending thereupon, detecting engine roughness in each engine cycle, judging if the detected engine roughness is within a predetermined acceptable range, counting occurrences of an unacceptable range of engine roughness in each cylinder, comparing the number of the engine cylinders in which unacceptable engine roughness is detected within a given duration with a predetermined first threshold, and controlling the air/fuel mixture so as to lean out the mixture at a first given rate as long as the number of cylinders is less than the first threshold and to enrich the mixture at a second given rate when the number of cylinder is greater than the first threshold.

BRIEF DESCRIPTION OF THE DRAWINGS

The present invention will be understood more fully from the detailed description given herebelow and from the accompanying drawings of the preferred embodiment of the invention, which, however, should not be taken to limit the invention but are for understanding and explanation only.

In the drawings:

FIG. 7 shows the relationship between engine coolant temperature and a starting enrichment correction value (KAs) which is stored in the memory of the control system and read out in terms of the engine coolant temperature when a starter switch is turned on;

FIG. 12 shows the variation of a time-dependent function (KTST) stored in the memory unit and read out in terms of a time period measured after the starter switch is turned on;

FIG. 24 is an explanatory illustration of a sample register in the control system of FIG. 3;

FIG. 25 is an explanatory illustration of a register for storing occurrences of unacceptable fluctuations in each engine cylinder;

DESCRIPTION OF THE PREFERRED EMBODIMENTS

Figure 1:
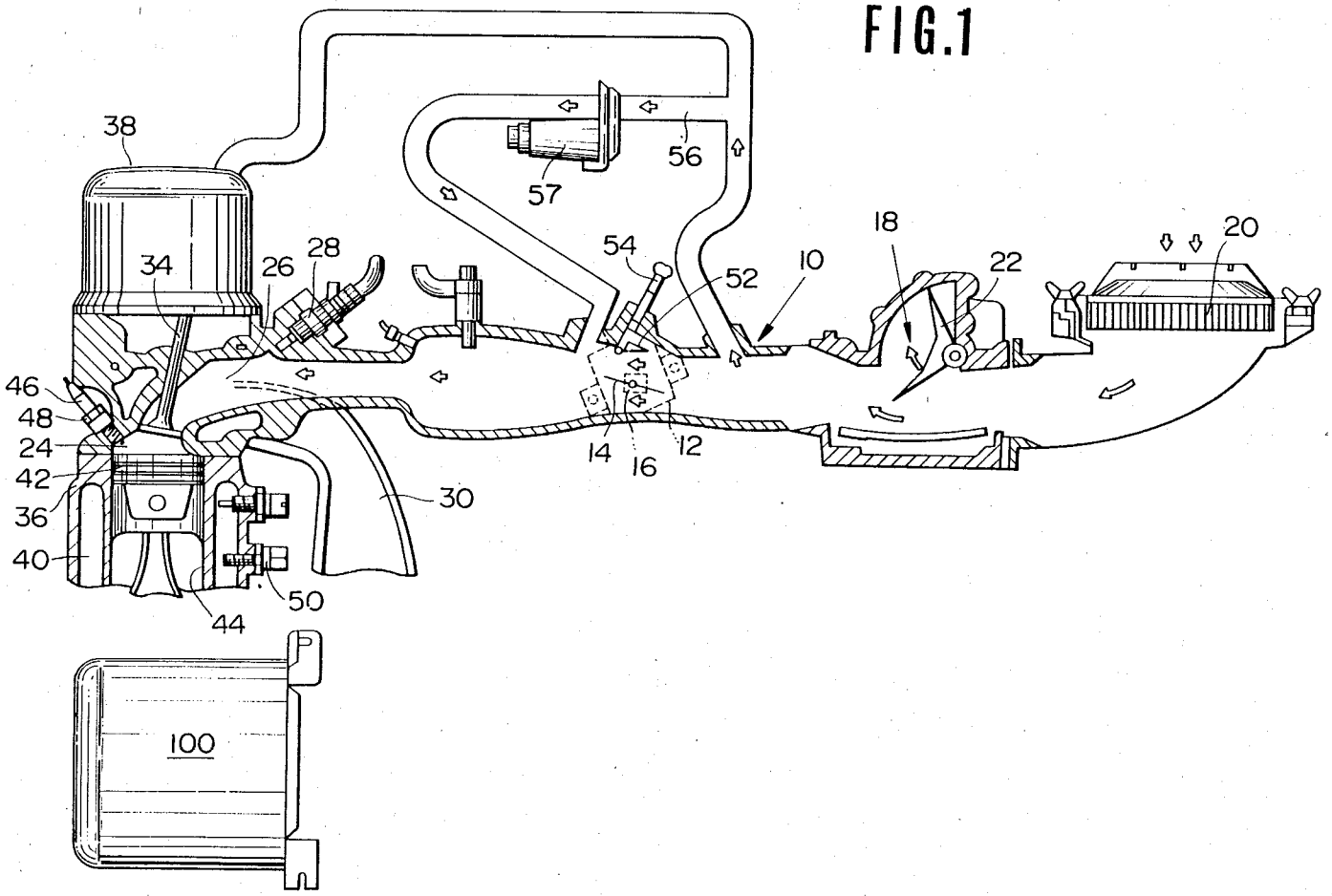
FIG. 1 is a fragmentary illustration of an air induction system of an internal combustion engine to which the preferred embodiment of air/fuel ratio control system according to the present invention is applied.
Figure 2:
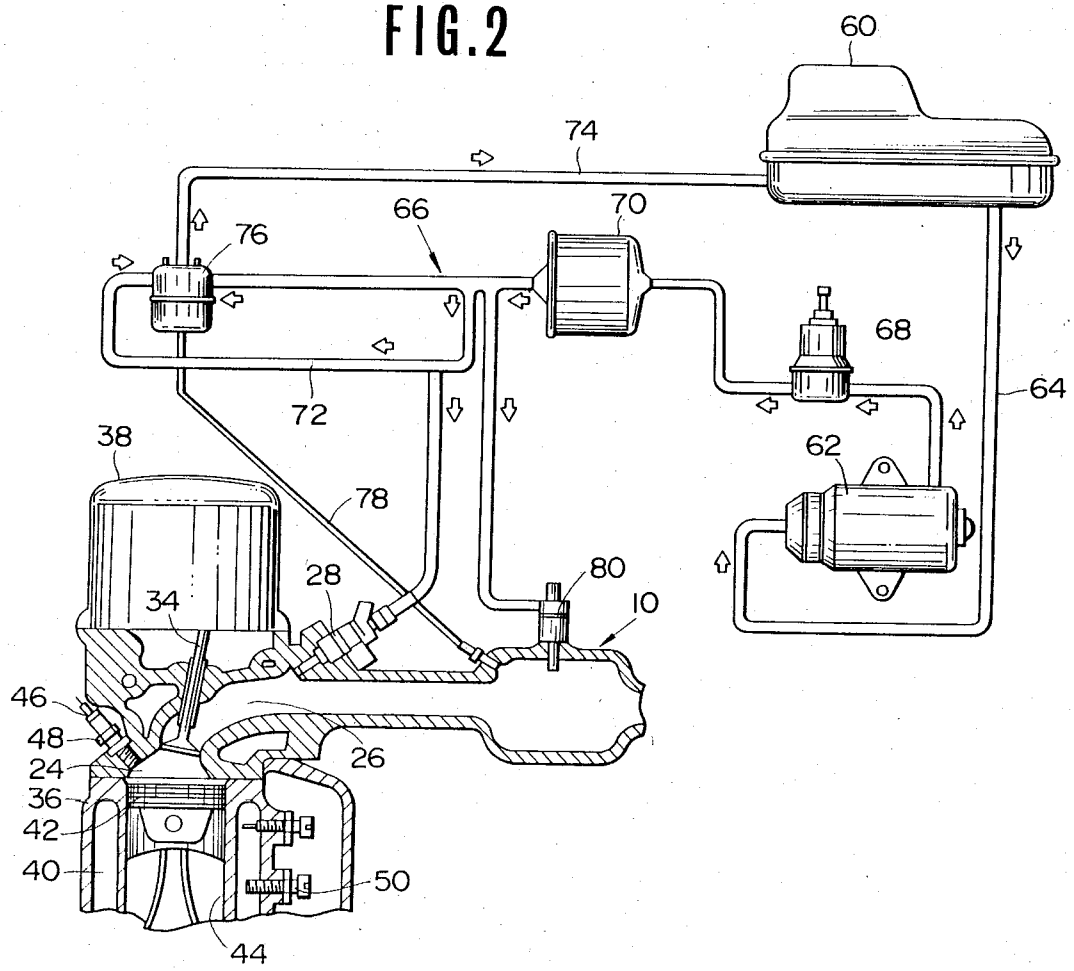
FIG. 2 is a fragmentary illustration of a fuel supply sysem in the internal combustion engine of FIG. 1.

Referring now to the drawings, particularly to FIGS. 1 and 2, a typically constructed fuel injection internal combustion engine to which the preferred embodiment of an air-fuel ratio control system is applied, is illustrated. FIG. 1 shows the induction system of the fuel injection internal combustion engine. An air intake passage 10 includes a throttle chamber 12 in which a pivotably controlled throttle valve 14 adjusts the intake air quantity depending upon its angular position. The throttle valve 14 is cooperatively connected to an accelerator pedal (not shown) in a per se well-known manner for adjusting the angular position thereof and thereby adjusting the intake air flow rate Q. A throttle position sensor 16 is assciated with the throttle valve 14 to detect the angular position of the throttle valve and produce a throttle angle signal having a value representative of the throttle valve angular position. An air flow meter 18 is provided in the air intake passage 10 at a point upstream of the throttle chamber 12 and downstream of an air cleaner 20. The air flow meter 18 has a flap 22 pivotable according to the flow rate of the intake air to produce an air flow signal (Sq) representative of intake air flow rate Q.

The air intake passage 10 is connected to each of the engine combustion chambers 24 via an intake manifold 26 into which one or more fuel injection valves 28 are inserted. In addition, the intake manifold 26 is connected to an exhaust passage 30 via an exhaust gas recirculation passage (not shown). An intake or suction valve 34 is provided in each combustion chamber 24 to control suction timing of the air/fuel mixture in synchronization with the engine revolution.

An engine cylnder block 36 with a cylinder head 38 defining the combustion chamber or chambers 24 therein has a water jacket 40 through which an engine coolant circulates for dissipation of the engine heat. A piston 42 is reciprocably housed in an engine cylinder 44 formed in the engine cylinder block for reciprocation as the engine runs. A spark ignition plug 46 is engaged to the cylinder head 38 so as to expose its electrodes to the combustion chamber 24 in order to effect spark ignition at a controlled timing in synchronization with the engine revolution. A pressure sensor 48, which detects the internal pressure in the combustion chamber and produces a pressure signal $S_p$ having a value representative of the pressure in the combustion chamber 24, is attached to the cylinder block. A coolant temperature sensor 50 is inserted into the water jacket 40 for detecting an engine coolant temperature to produce a temperature signal $S_t$ having a value representative of temperature condition of the engine coolant.

An idling air passage 52 bypasses the throttle valve 14 to allow passage of intake air therethrough. An idle adjuster screw 54 is associated with the idling air passage 52 for adjusting the engine idling speed. An auxiliary intake passage 56 with a vacuum controlled actuator 57 for adjusting auxiliary air flow rate is also connected to the air intake passage 10 via a reference pressure passage (not shown).

A crank angle sensor 58 is associated with an engine crankshaft for producing a position signal pulse after every given unit of crankshaft rotation, e.g. 1°, and a crank reference signal $C_{ref}$ pulse at a predetermined angular positin of each crankshaft rotation.

The throttle position sensor 16, the air flow meter 18, the coolant temperature sensor 50, the pressure sensor 48 and the crank angle sensor 58 are connected to a controller 100 to feed respective signals as engine operational parameter-indicative signals to the controller.

FIG. 2 shows the fuel injection system of the fuel injection internal combustion engine. A fuel tank 60 is connected to a fuel pump 62 via a suction tube 64. The fuel pump 62 pressurizes the fuel to circulate though the fuel supply circuit 66 and to provide fuel pressure for injection through the fuel injection valve 28. A fuel damper 68 for absorbing pulsatile fuel flow surges in the fuel supply circuit, and a fuel filter 70 is inserted in the fuel supply circuit. The fuel supply circuit 66 is connected to the fuel injection valve 28 via a fuel rail 72. In addition, the fuel supply circuit 66 is connected to a fuel return circuit 74 via a pressure regulator 76. The pressure regulator 76 adjusts the fuel pressure supplied to the fuel injection valve 28 in relative to the intake air vacuum pressure which is introduced through a conduit 78 to act as a reference pressure, and returns extra fuel to the fuel tank via the fuel return circuit 74.

A choke valve 80 supplies additional fuel under cold engine conditions.

Figure 3:
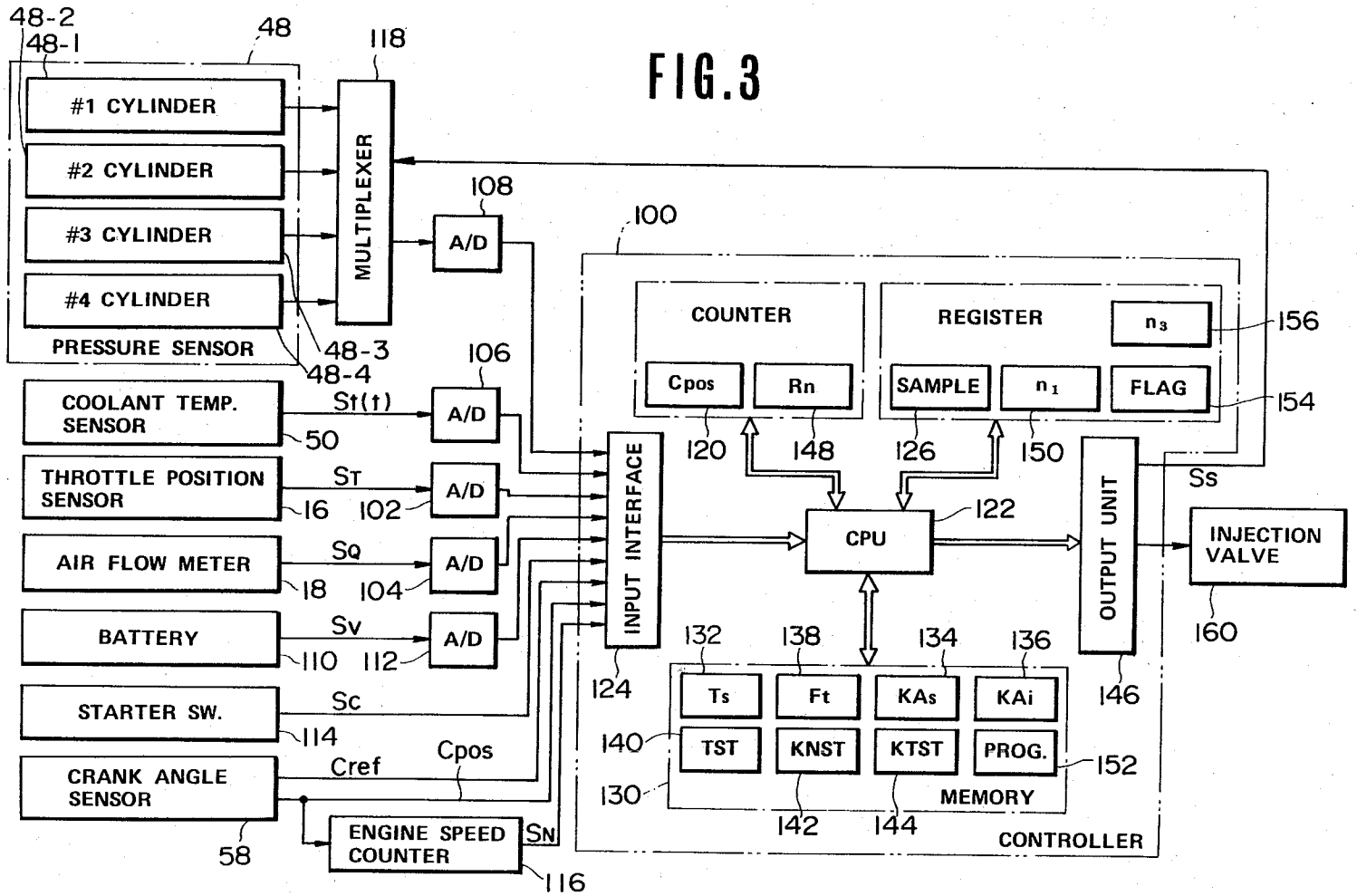
FIG. 3 is a block diagram of the preferred embodiment of the air/fuel ratio control system according to the present invention.

FIG. 3 schematically shows the preferred embodiment of the air/fuel ratio control system according to the present invention. As set forth above, the controller 100 is connected to the throttle position sensor 16, the air flow meter 18, the pressure sensor 48, the coolant temperature sensor 50 and the crank angle sensor 58 for detecting the engine operating condition. The controller 100 may comprise a digital computer or processor such as a microcomputer. Analog-to-digital converters 102, 104, 106 and 108 are respectively interposed between the throttle position sensor 16, the air flow meter 18, the pressure sensor 48 and the coolant temperature sensor 50 and the controller 100 in order to convert the throttle position signal $S_T$, the flow rate signal $S_q$, the pressure signal $S_p$ and the coolant temperature signal $S_t$ from their analog forms into corresponding digital signals.

The controller 100 is also connected to a vehicle battery 110 in order to receive battery voltage $S_v$ via an analog-to-digital converter 112. A starter switch 114 is also connected to the controller 100, which starter switch produces an ON/OFF signal depending upon its switch position. For instance, the starter switch 114 supplies an ON signal to the controller 100 while the engine is cranking.

On the other hand, the crank angle sensor 58 is connected to an engine speed counter 116 in order to supply the crank reference signal $C_{pos}$ to the latter. The engine speed counter 116 is adapted to produce an engine speed signal $S_N$ having a value indicative of the revolution speed of the engine determined on the basis of the crank reference signal.

The pressure sensor 48 is adapted to detect the internal pressure in the engine combustion chamber 24 to produce the pressure signal $S_p$ representative of the instantaneous pressure in the combustion chamber. In the shown embodiment, four pressure sensor 48-1, 48-2, 48-3 and 48-4 are used to detect the internal pressures in each of the four combustion chambers 24. A multiplexer 118 is interposed between the analog-to-digital converter 108 and the pressure sensors 48-1, 48-2, 48-3 and 48-4. The multiplexer 118 is connected to the controller 100 to receive a selector signals $S_s$ which selects one of the pressure sensors 48-1, 48-2, 48-3 and 48-4 to pass the corresponding pressure signal to the analog-to-digital converter 108, in synchronization with the engine revolution. Specifically, according to the shown embodiment, the controller 100 is adapted to detect the maximum internal pressure in the currently igniting combustion chamber and accordingly sends the selector signal $S_s$ to pass the pressure signal $S_p$ produced by the pressure sensor which measures the internal pressure of the corresponding igniting combustion chamber.

To detect the state of engine revolution, the controller 100 is provided with a crank position signal counter 120 for counting the pulses of the crank position signal $C_{pos}$ from the crank angle sensor 58 and inputted to CPU 122 through an input interface 124. The crank position signal counter 122 produces an angle signal $S_\theta$ having a value representative of the crankshaft angular position. In the shown embodiment, the crankshaft angular position at which the #1-cyclinder is in its top dead center (TDC) is assigned the value 0°. The crank angle signal counter 120 is adapted to count up to 720° and then reset to zero.

When the multiplexer 118 is operated by the selector signal to pass one of the pressure signals $S_{p1}$, $S_{p2}$, $S_{p3}$ and $S_{p4}$ to the controller 100, the pressure signal value is sampled and stored in a sample register 126. From the sampled pressure signal values, the controller derives the peak or maximum pressure $P_{max}$ and the crankshaft angular position $\theta_{pmax}$ at which the internal pressure in the corresponding combustion chamber 24 is maximized.

As is well known, the basic fuel injection amount $T_p$ is calculated on the basis of the intake air flow rate Q and the engine speed N according to the following formula:

$$T_p = K(Q/N) \quad (1)$$

where K is a constant.

The basic fuel injection amount $T_p$ is corrected by correction values respectively depending upon the engine operating conditions, such as battery voltage, coolant temperature condition, engine roughness and so forth.

Figure 6:
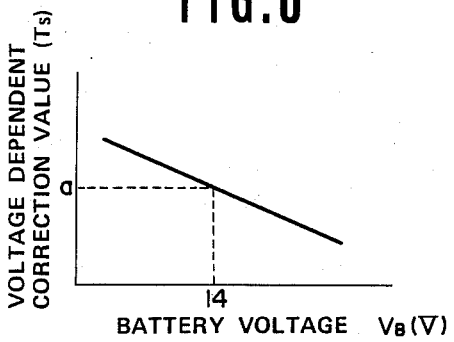
FIG. 6 shows the relationship between battery voltage and a voltage dependent correction value ($T_s$) which is stored in a memory unit in the control system of FIG. 3 and is read out in terms of the battery voltage to correct a basic fuel injection amount.

In the shown embodiment, a correction value depending upon the battery voltage $V_s$ varies according to the characteristics illustrated in FIG. 6. As will be appreciated from FIG. 6, the battery voltage dependent correction value $T_s$ is obtained from the following equation:

$$T_s = a + b(14 - V) \quad (2)$$

where a and b are constants.

The battery voltage dependent correction value $T_s$ may be stored in a memory 130 unit in the controller 100 in the form of a look-up table. The look-up table will be representated hereafter by the reference numeral 132. The table 132 is accessed according to the battery voltage inputted from the vehicle battery via an input interface 116.

Figure 7:
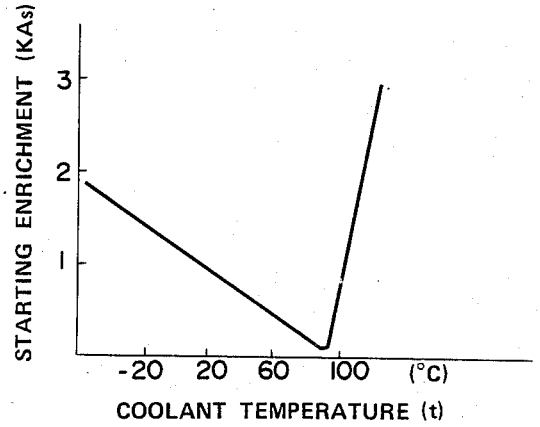

A correction value $KA_s$ for smooth cranking operation or smooth engine start-up characteristics is determined on the basis of the engine coolant temperature condition when the starter switch 108 is closed. The variation of the correction value $KA_s$ is represented by the characteristics shown in FIG. 7. The correction value $KA_s$, in other words, the starting enrichment correction value, is stored in the memory 130 in the form of a look-up table 134 which is accessed according to the coolant temperature when the starter switch 108 is first closed. The correction value $KA_s$ is gradually reduced to zero at a given rate while the engine is running. Therefore, the correction value $KA_s$ as shown in FIG. 7 is the initial value thereof.

Figure 8:
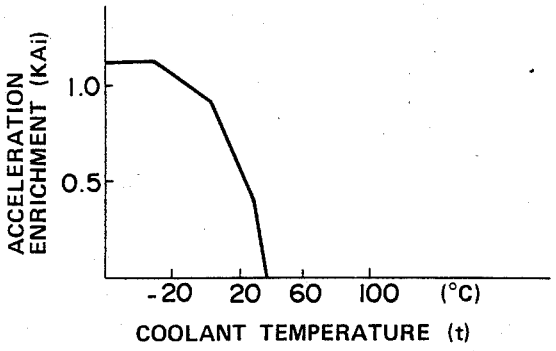
FIG. 8 shows the relationship between the engine coolant temperature and an acceleration enrichment correction value (KAi) which is stored in the memory unit and read out in terms of the engine coolant temperature when the engine is started.

While the engine is still cold after idling, an acceleration enrichment correction will be performed in order to improve the start-up characteristics of the vehicle so that vehicle can smoothly "pick up". For this purpose, an acceleration enrichment correction value $KA_i$ is stored in the memory 130 in the form of a look-up table 136, with the characteristics shown in FIG. 8. The correction value $KA_i$ is read out in response to a throttle angle signal indicating acceleration, with reference to the coolant temperature at the moment of acceleration demand. The correction value $KA_i$ is gradually reduced to zero at a given rate after acceleration enrichment is performed with the read-out initial correction value $KA_i$.

Figure 9:
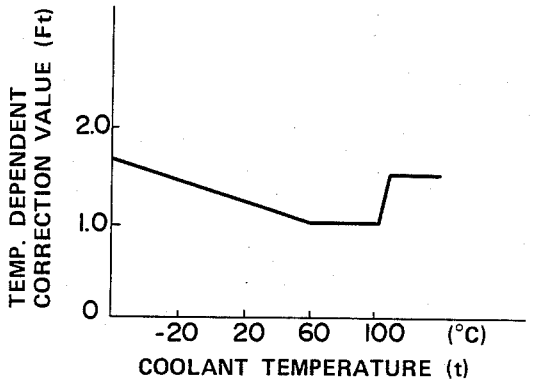
FIG. 9 shows the relationship between the engine coolant temperature and a temperature-dependent correction value (Ft) which is stored in the memory unit and read out in terms of the engine coolant temperature.

During engine warm-up, a temperature dependent correction will be performed by modifying the basic fuel injection value with a temperature dependent correction value $F_t$. The correction value $F_t$ is stored in the memory 130 in the form of a look-up table 122. This look-up table 138 is accessed according to the cooling temperature signal $S_t$ and varies depending upon the coolant temperature as shown in FIG. 9.

An additional correction mediated by an exhaust gas $O_2$ sensor (not shown) or an exhaust gas temeprature sensor (not shown) will be performed.

Figure 10:
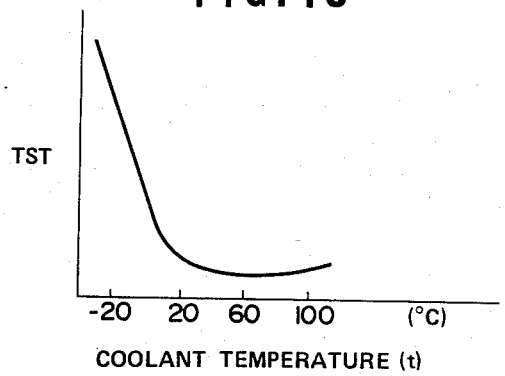
FIG. 10 shows the variation of a temperature dependent function (TST) stored in the memory unit to be read out in terms of the engine coolant temperature.
Figure 11:
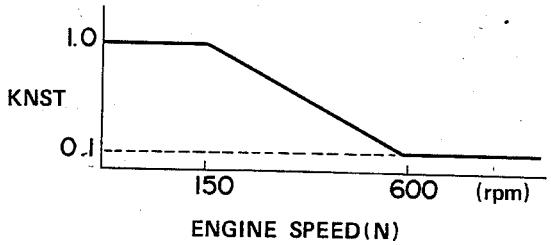
FIG. 11 shows the variation of a engine speed-dependent function (KNST) stored in the memory unit to be read out in terms of the instantaneous engine speed.
Figure 12:
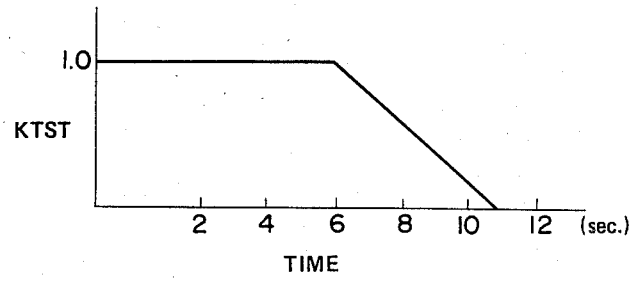

During engine cranking, the engine starting enrichment correction will be made in accordance with the following equations:

$$T_1 = T_p \times (1 + KA_s) \times 1.3 + T_s \quad (3)$$

$$T_2 = TST \times KNST \times KTST \quad (4)$$

where TST is a function of the coolant temperature varying according to the coolant temperature as illutrated in FIG. 10; KNST is a function of the engine speed N varying according to the engine speed as illustrated in FIG. 11; and KTST is a function of the period after the starter switch 114 is closed to start the engine which varies as illustrated in FIG. 12.

The starting enrichment correction is performed by choosing the one of the foregoing $T_1$ and $T_2$ which is larger than the other. The functions TST, KNST and KTST are stored in the memory 130 the form of look-up tables 140, 142 and 144, as shown in FIG. 3.

According to the shown embodiment, another correction is made in accordance with engine roughness. As set forth above, during lean-mixture combustion, engine roughness, or more specifically cycle-to-cycle engine speed fluctuation, increases with the leanness of the air/fuel ratio. This is due to fluctuations in combustion quality in the combustion chamber. For instance, when a lean mixture is used, the transmission speed of the combustion front in the mixture gas in the combustion chamber varies significantly. This implies a rather high possibility of engine knocking and mis-firing. This fluctuation in combustion quality may be recognized by checking the crankshaft angular position at which the internal pressure P in the combustion chamber is maximized. As roughness increases, the range of variation of the crankshaft angular position at maximum internal pressure becomes wider than during engine operation with a richer mixture.

Figure 13:
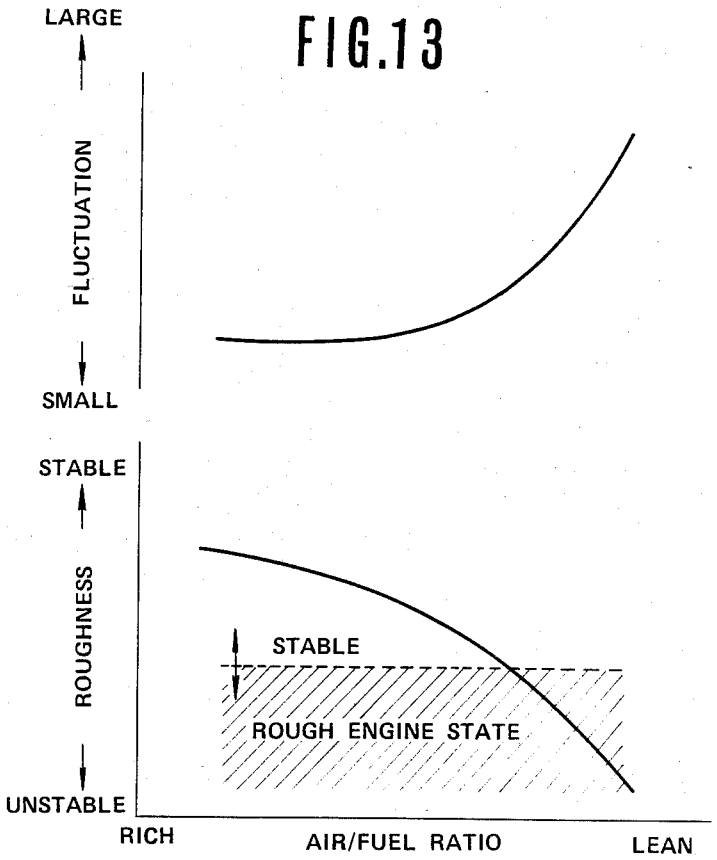
FIG. 13 shows the relationship between cycle-to-cycle fluctuations and engine roughness.
Figure 14:
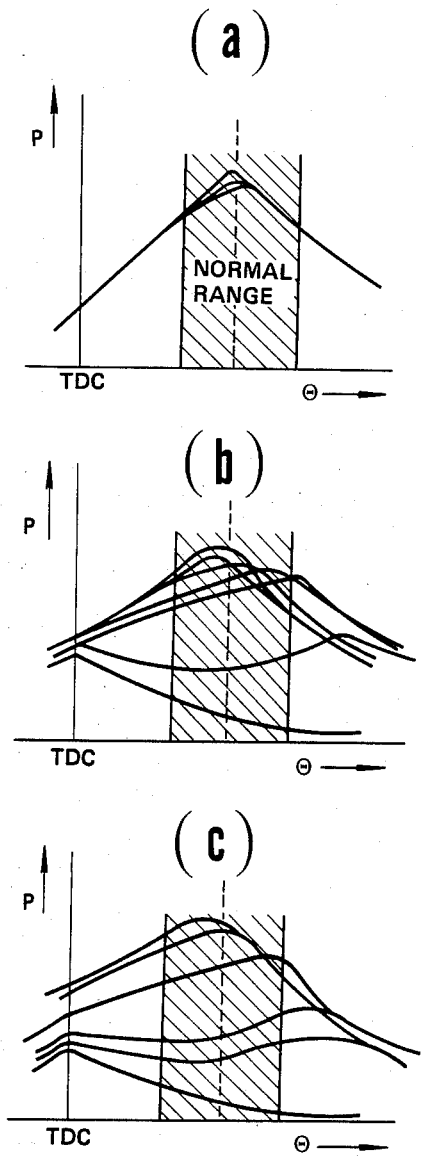
FIGS. 14(*a*) to (*c*) respectively show exemplary variations of the internal pressure in the engine combustion chamber in relation to the crank shaft angular position, in which the air/fuel mixture ratio of FIG. 14(*a*) is the richest and the air/fuel ratio of FIG. 14(*c*) is the leanest.
Figure 15:
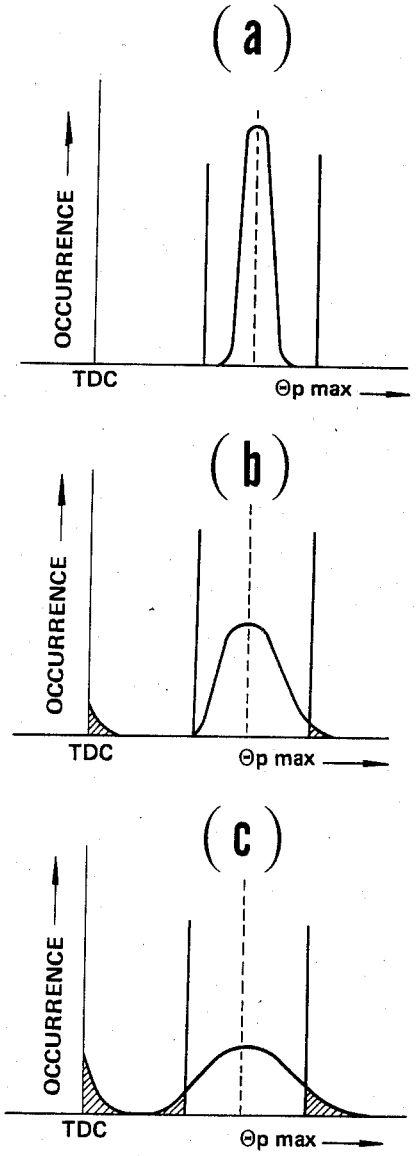
FIGS. 15(*a*) to (*c*) respectively show exemplary distributions of the crankshaft angular positions at which the maximum internal pressure in the combustion chambers is obtained, in which the mixtures burned in the engine combustion chamber respectively correspond to those in FIGS. 14(*a*) to (*c*)

The relationships of combustion fluctuations and engine roughness with respect to the mixture ratio are illustrated in FIG. 13, which were obtained by varying the mixture ratio while holding the ignition timing at MBT (Minimum advance for Best Torque). As will be appreciated from FIG. 13, increases in the mixture ratio cause retardation of the crankshaft angular position at which the internal pressure in the combustion chamber is maximized and widening of the range variation of of the maximum pressure crankshaft position. Exemplary fluctuations and analyses thereof are shown in FIGS. 14 and 15. In FIGS. 14, (*a*), (*b*) and (*c*) respectively show traces of the variation of the internal pressure in the combustion chamber at various mixture ratios, namely, FIG. 14(*a*) shows combustion of the richest mixture and FIG. 14(*c*) shows combustion of the leanest mixture. On the other hand, FIGS. 15(*a*), (*b*) and (*c*) respectively show distributions of the crankshaft angular position at which the internal pressure in the combustion chamber is maximized, which crankshaft angular position will be hereafter referred to as "maximum pressure angle $Q_{pmax}$". The mixture ratios used in the experiments of FIGS. 15(*a*), (*b*) and (*c*) correspond to those of FIGS. 14(*a*), (*b*) and (*c*) respectively. As will be appreciated, when the mixture is sufficiently rich, the range of variation of the maximum pressure angle $Q_{pmax}$ remains within a normal range (16° to 20° ATDC) which is approximately centered on the spark advance at MBT. On the other hand, when the mixture is lean, engine roughness is increased so that the range of variation of the maximum pressure angle $Q_{pmax}$ extends beyond the normal range. The hatched areas in FIGS. 15(*b*) and (*c*) represent occurrences of the maximum pressure angle $Q_{pmax}$ outside of the normal range.

Figure 16:
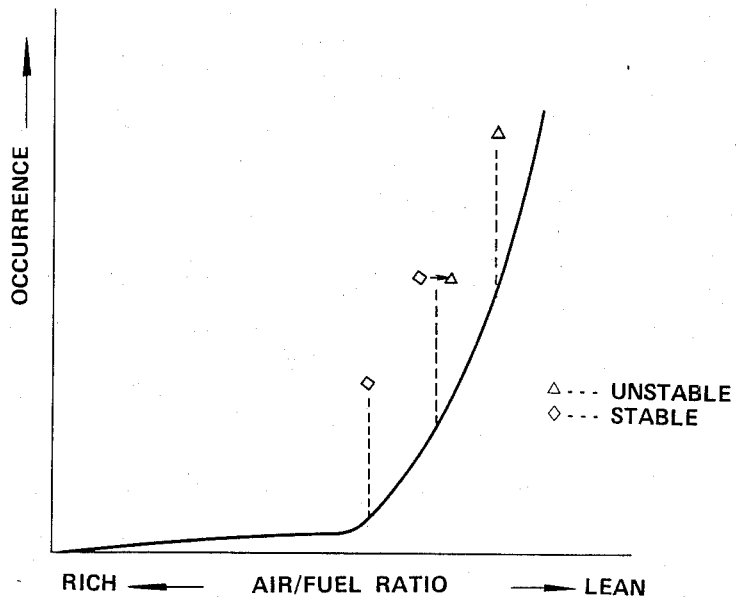
FIG. 16 shows the relationship between occurrence of roughness in the engine and the air/fuel ratio.

FIG. 16 shows illustrates the frequency of occurrences of the maximum pressure angle $Q_{pmax}$ outside of the normal range. As will be appreciated, when the occurrence frequency is low, the engine is regarded as running stably, while when the occurrence frequency is high, the engine is regarded as running unstably. Therefore, by monitoring occurrences of the maximum pressure angle $Q_{pmax}$ outside of the normal range, the degree of engine roughness can be measured.

Accordingly, the correction of the fuel injection amount depending upon the engine roughness may be performed on the basis of the frequency of occurrences of the maximum pressure angle $Q_{pmax}$ outside of the normal range.

Figure 4:
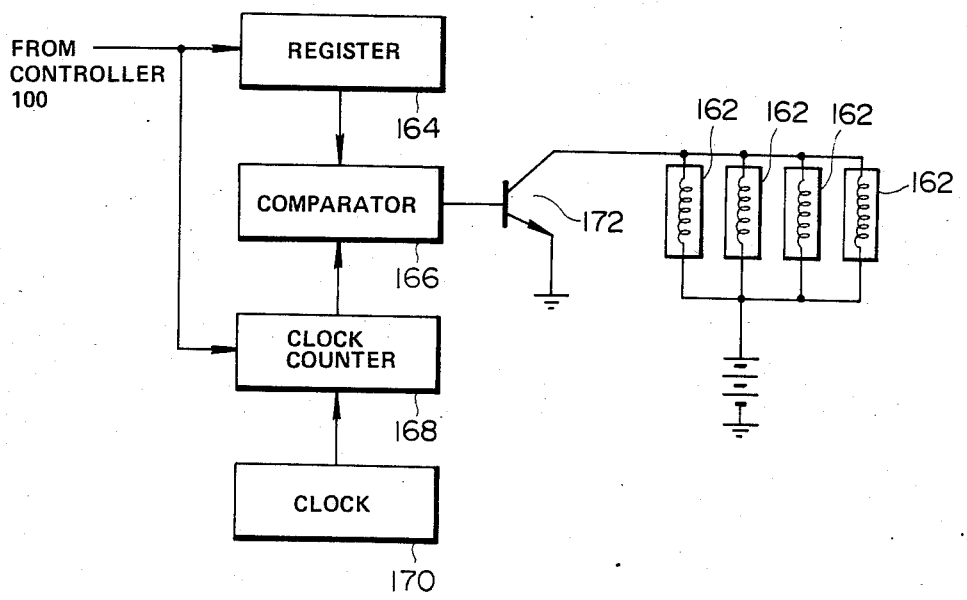
FIG. 4 is a block diagram of a fuel injection valve driver circuit employed in the air/fuel ratio control system of FIG. 3.
Figure 5:
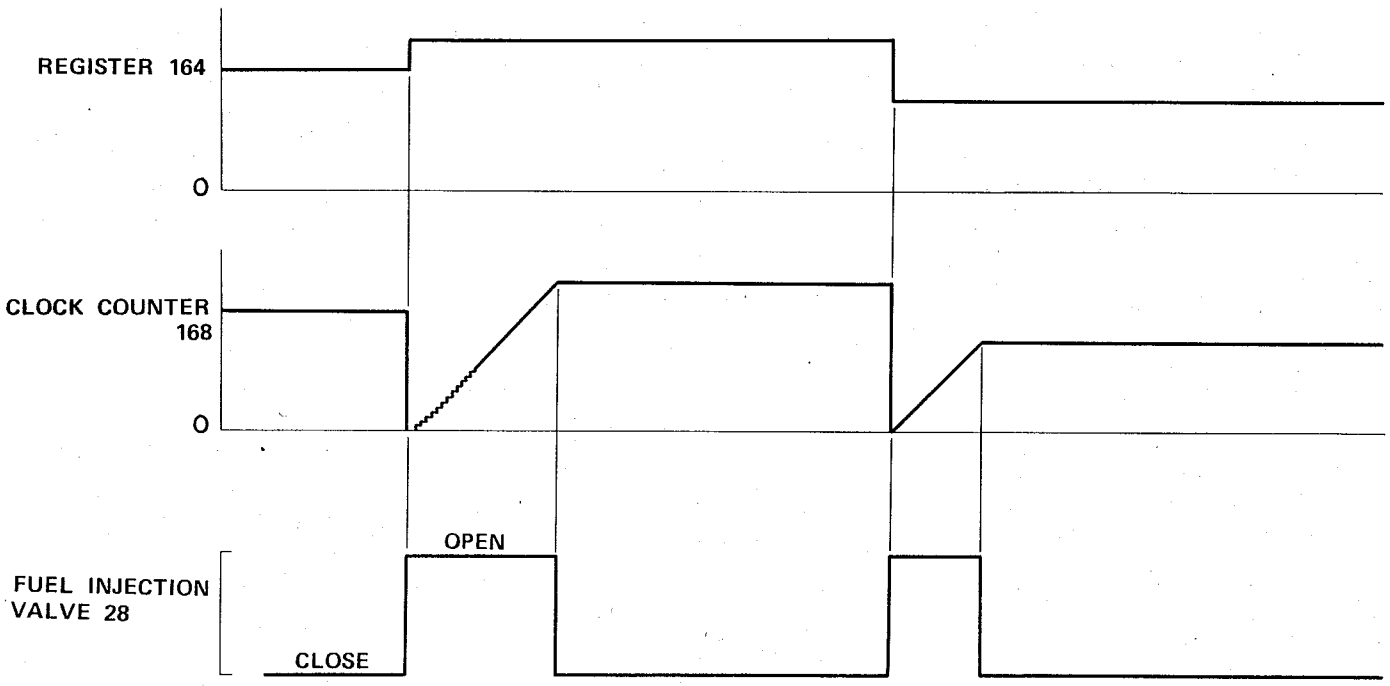
FIG. 5 is a timing chart of the fuel injection valve driver circuit of FIG. 4.

The controller 100 thus produces a pulse-form fuel injection signal $T_A$ having a pulsewidth representative of the fuel injection amount derived by correcting the basic fuel injection amount $T_p$ by the correction values described above. The fuel injection signal $T_A$ is output via an output unit 146 to the fuel injection valve driver circuit 160 including an electrically controlled actuator 162 (see FIG. 4) to open and close the fuel injection valve 28. As shown in FIG. 4, the fuel injection valve driver circuit 160 includes a register 164 which is adapted to temporarily hold the fuel injection pulse $T_A$. The register 164 is associated with a comparator 166 to reset the latter in response to the leading edge of the fuel injection pulse. The fuel injection pulse $T_A$ is also supplied to a clock counter 168 which is, in turn, connected to a clock generator 170 to receive a clock pulse signal. The clock counter 168 is adapted to count the pulses of the clock signal and output a counter signal indicative of its counter value. The clock counter 168 is responsive to the leading edge of the fuel injection pulse $T_A$ to clear its counter value to zero.

The register 164 outputs a register signal indicative of the stored pulse width of the fuel injection pulse $T_A$ to the comparator 166. The comparator 166 compares the register signal value with the counter signal value from the clock counter 168. The comparator 166 outputs a LOW-level comparator signal as long as the register signal value is larger than the counter signal value. The comparator 166 outputs a comparator signal to the base electrode of a transistor 172. The transistor 172 is turned OFF by the LOW-level comparator signal to supply a bias voltage to the actuator 162 which energizes the fuel injection valve 28 to its open position. The comparator signal level remains LOW while the register signal value is greater than the counter signal value. The comparator signal level goes HIGH when the counter signal value becomes equal to the register signal value to turn the transistor 172 on. As a result, the actuators 162 are deactivated to close the fuel injection valve. Therefore, the fuel injection valve is opened for a duration corresponding to the fuel injection pulse width.

Figure 17:
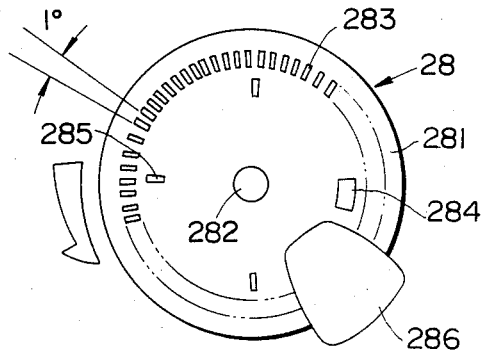
FIG. 17 is a front elevation of a crank angle sensor applied to the control system of FIG. 3.
Figure 18:
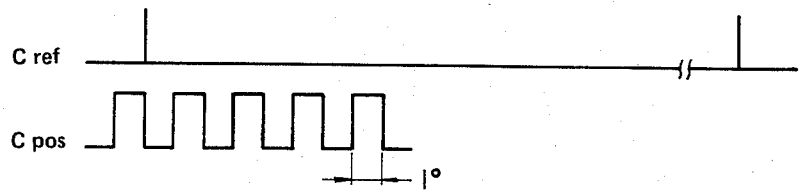
FIG. 18 shows waveforms of the crank reference signal $C_{ref}$ and the crank position signal $C_{pos}$.

The crank angle sensor 58 and the pressure sensors 48-1, 48-2, 48-3 and 48-4 are used to recognize the maximum pressure angle $\theta_{pmax}$. As shown in FIG. 17, the crank angle sensor has a rotor fixed to the crankshaft 282 for rotation therewith. Slits 283 for the crank position signals $C_{pos}$ are arranged radially symmetrically around the rotor 281. The separation between each of the adjacent slits 283 correspond to 1° of crankshaft rotation. Slit 284 and slits 285 are arranged at positions corresponding to respectively predetermined crankshaft angular positions corresponding the top dead center of each of the cylinders. The slit 284 is formed at a position corresponding to compression top dead center of #1-cylinder and has a greater length than the slits 285 which are formed at positions respectively corresponding to compression top dead centers of the other cylinders. A photoelectric sensor element 286 faces one surface of the rotor 281 to produce a crank position signal $C_{pos}$ and crank reference signal $C_{ref}$ as shown in FIG. 18.

Though a specific structure has been illustrated above for the preferred embodiment, it is possible to replace the illustrated crank angle sensor with any type or structure of crank angle sensor. Furthermore, though the shown engine speed sensor 116 counts the crank position signal pulses $C_{pos}$ and produces the engine speed signal $S_N$, this engine speed counter 116 is not always necessary for the control system and can be replaced with any engine speed detector or sensor adapted to detect the engine revolution speed and to produce an engine speed indicative signal. It would also be possible to calculate the engine speed parameter by processing the crank angle signals, e.g., the crank position signals $C_{pos}$ or crank reference signals $C_{ref}$ in the controller. Furthermore, a crank angle sensor which produces only the crank position signal would also be applicable to the control system.

FIGS. 19 to 22 show an example of the pressure sensor 48 adapted to detect the internal pressure in the combustion chamber 24. The shown pressure sensor 48 is in the form of washer for a fastener bolt.

Figure 19:
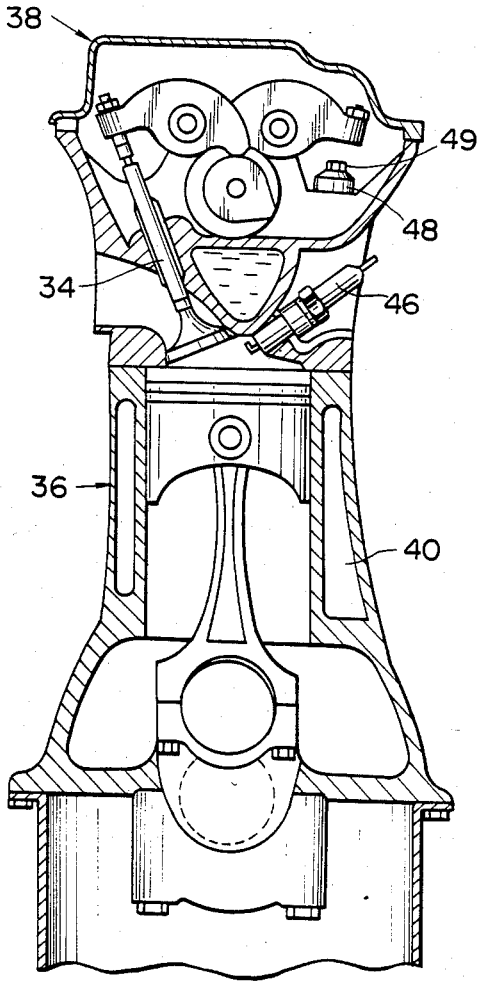
FIG. 19 is a sectional view of the engine showing installation of a pressure sensor in the control system of FIG. 3.

As shown in FIG. 19, the cylinder head 34 is attached to the cylinder block 36 by means of cylinder head bolts 49 (only one of which is shown). An annular pressure sensor 48 takes the form of the washer and fits around a section of the bolt 49 outwardly projecting from the cylinder head 34. The pressure sensor 48 is clamped between the cylinder head 34 and the head of the bolt 49 in a manner similar to a normal washer.

Figure 20:
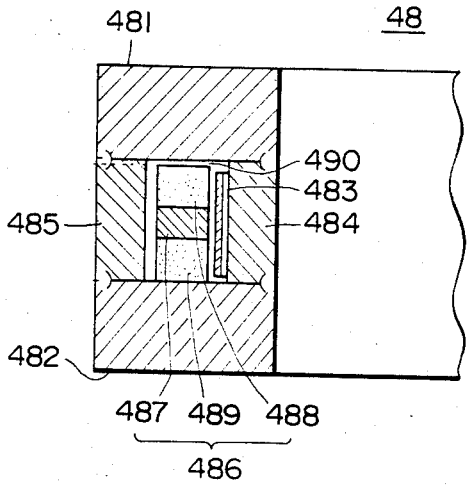
FIG. 20 is a partial cross-section of the pressure sensor.
Figure 21:
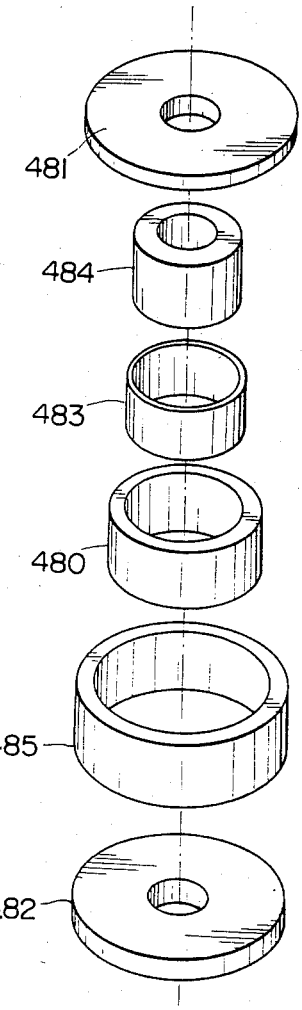
FIG. 21 is an exploded perspective view of the pressure sensor.

FIGS. 20 and 21 show the details of the pressure sensor 48. The pressure sensor 48 includes a casing or body having a pair of upper and lower metal discs 481 and 482 aligned and spaced axially. These discs 481 and 482 each have a central bore accommodating the cylinder head bolt. The body of the pressure sensor has concentrically arranged inner and outer rings 484 and 485 positioned between the discs 481 and 482 and extending coaxially with respect to the discs 481 and 482. These rings 484 and 485 have equal axial dimensions, by which the discs 481 and 482 are distant from each other. The rings 484 and 485 are radially spaced to define an annular inside space in conjunction with the discs 481 and 482. The rings 484 and 485 are made of relatively rigid metal, such as steel. Upper end faces of the rings 484 and 485 are welded to the lower end face of the upper disc 481. Lower end faces of the rings 484 and 485 are welded to the upper end face of the lower disc 482. The central bore of the inner ring 484 is designed to receive the cylinder head bolt.

A ring-shaped sensing member 486 is disposed in the inside space and extends coaxially with respect to the discs 481 and 482. The sensing member 486 includes axially aligned ring electrode 487, and ring-shaped mechanical-electro transducing members 488 and 489, such as ceramic piezoelectric elements, sandwiching the electrode 487 therebetween. The upper end face of the electrode 487 contacts and is attached to the lower end face of the upper piezoelectric element 488. The lower end face of the predetermined clearance 490 in an original condition where the pressure sensor 48 is detached from the bolt 49 (see FIG. 19). The upper end face of the piezoelectric element 488 is in contact with the lower end face of the upper disc 481 when the pressure sensor 48 is attached in place around the bolt 49, as described hereinafter. The upper piezoelectric element 488 serves to produce an electrical signal, which can be applied between the upper disc 481 and the electrode 486.

The pressure sensor 48 fits around the bolt 49 (see FIG. 19) in such a manner that the bolt 49 extends through the central bores of the discs 481 and 482, and the inner ring 484. The top surface of the pressure sensor 48 contacts the head of the bolt 49. The bottom surface of the pressure sensor 48 contacts the cylinder head 34 (see FIG. 19). In this way, the pressure sensor 48 is clamped between the bolt 49 and the cylinder head 34. The output signal of the pressure sensor 48 is transmitted via its body and terminal.

Figure 22:
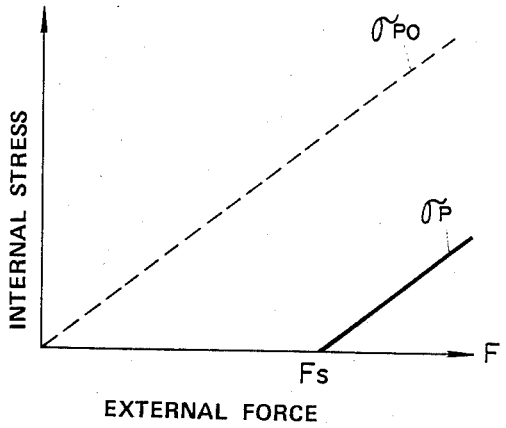
FIG. 22 shows the relationship between internal stress and external force in the pressure sensor.

As shown in FIG. 22, as an external force F applied to the pressure sensor 48 increases from zero to a preset threshold level Fs, internal stress $\sigma p$ of the piezoelectric elements 488 and 489 remains zero, since the clearance 490 is maintained and hence the sensing member 486 remains out of contact with the upper disc 481 and receiving no external force. When the external force F reaches the threshold level Fs, deformation of the body of the sensor 48 assumes a value at which the clearance 490 disappears and thus the sensing member 486 comes into contact with the upper disc 481. As the external force F increases from the threshold level Fs, the internal stress $\sigma p$ increases linearly with the external force F. In FIG. 22, the broken line indicates the relationship between external force F and internal stress $\sigma po$ of the piezoelectric elements 488 and 489 obtained under conditions where the sensing member 486 originally contacts the upper disc 481, which corresponds to a conventional case. As is apparent from FIG. 22, this internal stress $\sigma po$ increases proportionally with increases in the external force F from zero.

A similar pressure sensor has been disclosed in the Published Japanese Utility Model Application No. 40-10332, published on Apr. 7, 1965. The disclosure of the above-identified Published Japanese Utility Model Application is hereby incorporated by reference.

As will be appreciated, the pressure sensor 48 is attached to the engine cylinder head at locations respectively adapted to detect variation of vibration due to variation of the internal pressure in the combustion chamber 24. In the preferred embodiment, the pressure sensor 48-1 is attached to the cylinder head at the location corresponding to the #1-cylinder to produce the pressure signal $S_{p1}$ representative of the internal pressure in the #1-cylinder. Similarly, the pressure sensors 48-2, 48-3 and 48-4 are respectively adapted to detect the internal pressure of respectively corresponding #2-, #3- and #4-cylinders to produce the pressure signals $S_{p2}$, $S_{p3}$ and $S_{p4}$. Though the pressure sensor in the shown embodiment has been attached to the engine cylinder head by mean of the cylinder head bolt, it may be possible to attach the pressure sensor by different way, for example, by mean of the spark ignition plug. Therefore, manner of attching the pressure sensor to the engine cylinder head may not be specified to the shown specific manner. Further, it would be possible replace the pressure sensor as illustrated with any appropriate sensor adapted to detect the internal pressure in the combustion chamber and to produce a pressure indicative signal.

Figure 23:
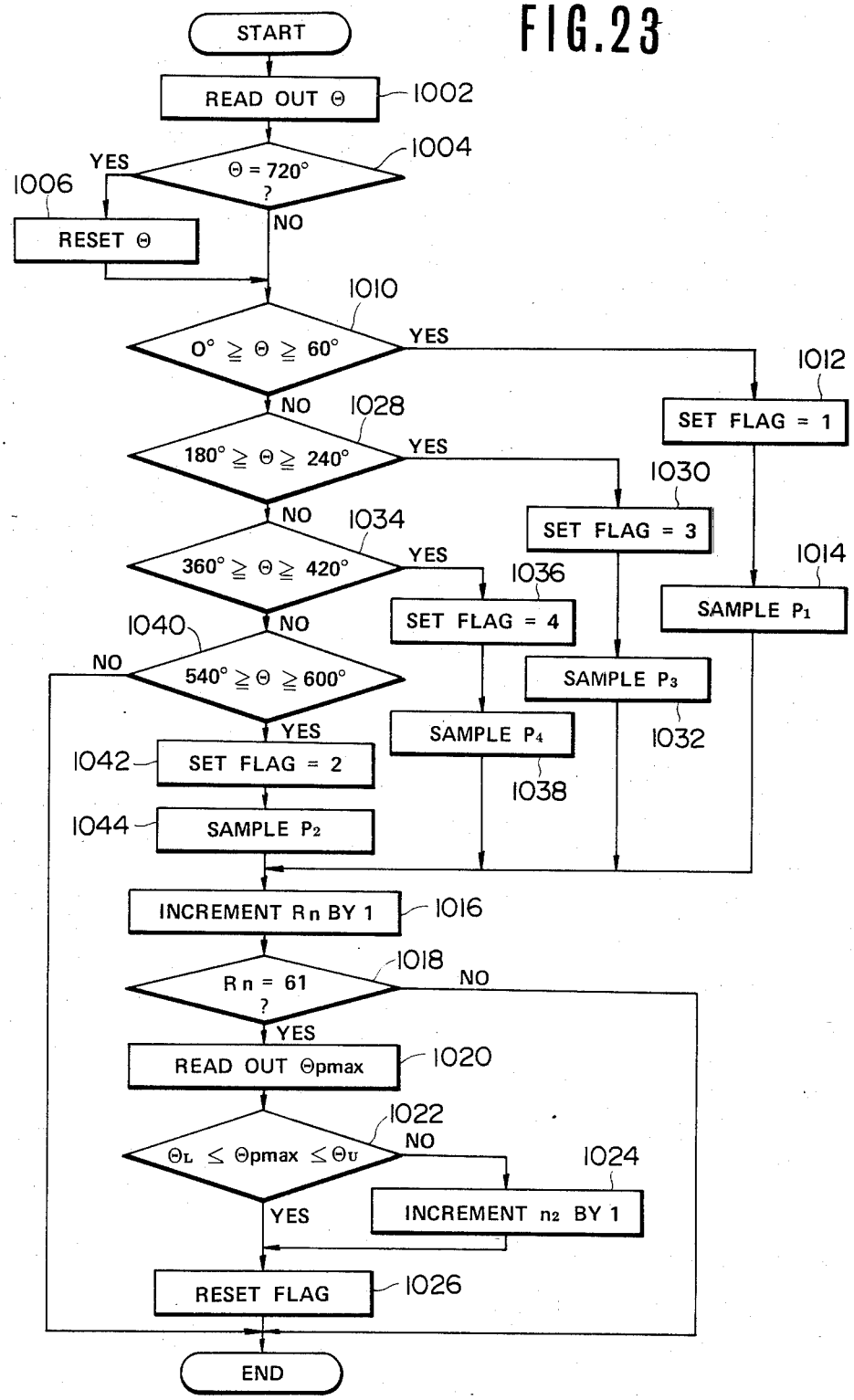
FIG. 23 is a flowchart of a program for monitoring engine roughness.

The operation of the control system of FIG. 3 for detecting the engine roughness will be described in detail with reference to the flowchart of FIG. 23. The flowchart of FIG. 23 is designed to be executed by CPU 122 every time the crank position signal $C_p$ is inputted from the crank angle sensor 58. The engine roughness detecting program of FIG. 23 is stored in a program memory 152 of the memory unit 130 and read by the CPU 122 in response to the crank position signal $C_{pos}$. The CPU 122, at the same time, feeds the crank position signal $C_{pos}$ to the crank position signal counter 120. The crank position signal counter 120 outputs the counter signal having a value representative of the crankshaft angular position to the CPU 122 when accessed.

In response to the crank position signal $C_{pos}$ the program of FIG. 23 is executed. Immediately after START, the crank position signal counter 120 is accessed to read the counter value representative of the crankshaft angular position $\theta$ at a block 1002. At a block 1004, the counter value $\theta$ is checked to see if it is equal to 720°, which value corresponds to crankshaft angular position at which #1-cylinder is at compression top dead center. If the counter value is equal to 720°, then the counter is reset to zero at a block 1006. Otherwise, the counter value $\theta$ is checked to see if it is within the angular range of 0° to 60°, indicating that the #1-cylinder is in its combustion stroke at a block 1008. If the counter value is indicative of a crankshaft angular position within the range of 0° to 60°, then a flag register 154 is set to 1, indicating that the CPU is sampling pressure data in the #1-cylinder at a block 1010. Then, CPU feeds the selector signal $S_s$ to the multiplexer 118 in order to transmit the pressure signal $S_{p1}$ of the pressure sensor 48-1 through the output unit 146. The pressure signal $S_{p1}$ indicative of the pressure in the #1-cylinder is stored in the corresponding address of the sample register 126 at a block 1014.

As shown in FIG. 24, the sample register 126 has a plurality of storage addresses to store the sampled pressure signal values in order. Namely, the address $\theta_1$ is adapted to store the first pressure signal value, the address $\theta_2$ is adapted to store the second pressure signal value, and so on. The CPU 122 loads each of the storage addresses $\theta_1$ to $\theta_{60}$ according to a counter value $R_n$ in a counter 148, which counter value $R_n$ is incremented by one (1) per each cycle of program execution, at a block 1016.

In the shown embodiment, the sample register 126 is adapted to sample the pressure signal value for the crankshaft rotation from the top dead center to 60° after the top dead center (ATDC). Therefore, the sample register 126 has 60 storage addressed $\theta_1$ and $\theta_{60}$ and the counter 148 is adapted to count to 61 before being reset to zero.

The counter value $R_n$ is checked at a block 1018. If the counter value $R_n$ is less than 61, program execution goes to END. On the other hand, when the counter value is equal to 61, the CPU refers to the sample register 126 to find out the peak value or maximum pressure $P_{max}$ and the storage address $\theta_{pmax}$ which holds the maximum pressure signal value $P_{max}$. Since the storage address number corresponds to the crankshaft angular position from TDC, the address number of the storage address in which the maximum pressure signal value $P_{max}$ is stored is representative of the maximum pressure angle $\theta_{pmax}$. This determination of the maximum pressure angle $\theta_{pmax}$ is performed at a block 1020. The obtained maximum pressure angle $\theta_{pmax}$ is compared with lower and upper thresholds $\theta_L$ and $\theta_U$ at a block 1022. When the maximum pressure angle $\theta_{pmax}$ is greater than the lower threshold $\theta_L$ and less than the upper threshold $\theta_U$, then the program execution goes to END. If the maximum pressure angle $\theta_{pmax}$ is equal to or less than the lower threshold $\theta_L$ or equal to or greater than the upper threshold $\theta_U$, a register 150 is incremented by 1 at a block 1024.

As shown in FIG. 25, the register 150 has a plurality of register addresses, one of which is accessed by the CPU according to the value of the flag register 154. Therefore, one of the register addresses #1 to #4 is incremented by 1 at the block 1024. Each register address #1 to #4 corresponds to a cylinder. Therefore, the value in each register address represents the number of occurrences of the maximum pressure angle out of the normal angle range which is defined by the lower and upper thresholds $\theta_L$ and $\theta_U$.

When the crankshaft angular position $\theta$ is out of the range 0° to 60°, then the crankshaft angular position $\theta$ is again checked to see if it is within a range of 180° to 240° at a block 1028. If the crankshaft angular position $\theta$ is within the range, i.e., 180° to 240°, then, the flag register 154 is set to 3, representing sampling of the pressure signal from the pressure sensor 48-3 adapted to detect the internal pressure of the #3-cylinder at a block 1030. Then, the CPU 122 feeds the selector signal $S_s$ to the multiplexer 118 in order to transmit the pressure signal $S_{p3}$. At a block 1032, the pressure signal value of the pressure signal $S_{p3}$ is loaded into the corresponding storage address of the sample register 126. After this step 1032 of sampling the pressure signal value, control goes to the step 1016 and the subsequent steps of detecting the maximum pressure angle $\theta_{max}$ and judging whether the obtained maximum pressure angle $\theta_{pmax}$ is within the normal angle range.

If the crankshaft angular position $\theta$ when checked at the block 1028 is out of the range 180° to 240° ATDC then it is checked again for the range 360° to 420° at a block 1034. If it is in this range, the flag register 154 is set to 4 at a block 1036. At the same time, the selector signal $S_s$ is fed to the multiplexer 118 to pass the pressure signal $S_{p4}$ from the pressure sensor 48-4. The pressure signal $S_{p4}$ is stored in the corresponding address of the sample register 126, at a block 1038. After this step 1038, program control goes to the step 1016 and the subsequent steps of detecting the maximum pressure angle $\theta_{pmax}$ and judging whether the obtained maximum pressure angle is within the given normal angle range.

If the crankshaft angular position $\theta$ when checked at the block 1034 is out of the range 360° to 420°, the angle $\theta$ is once again checked to see if it is in a range of 540° to 600° at a block 1040. If the answer of the block 1040 is NO, program goes to END. On the other hand, if YES, the flag register 154 is set to 2 at a block 1042. At this time, the selector signal $S_s$ is fed to the multiplexer 118 to pass the pressure signal $S_{p2}$ from the pressure sensor 48-2. As a result, the pressure signal value $P_2$ of the pressure signal $S_{p2}$ is sampled at a block 1044. After sampling the pressure signal value $P_2$, process goes to the block 1016 and the subsequent blocks as set forth above.

As set forth above, by execution of the program of FIG. 23, occurrence of combustion in which the maximum pressure angle $\theta_{pmax}$ is out of the given normal range is monitored. In the foregoing embodiment, the lower threshold $\theta_L$ is 10° ATDC and the upper threshold $\theta_U$ is 25° ATDC. Therefore, when the maximum pressure angle $\theta_{pmax}$ is in a range of 10° ATDC to 25° ATDC, the combustion in the cylinder being checked is regarded as taking place normally or stably. When the maximum pressure angle $\theta_{pmax}$ is out of the range (10° ATDC to 25° ATDC), it is regarded that the combustion in the checked cylinder is taking place unstably. Such occurrences of unstable combustion are counted by the register 150. As illustrated in FIG. 25, the register 150 employed in the shown embodiment has four register address adapted to hold values representative of the occurrences of unstable combustion in each of the engine cylinders.

Figure 26:
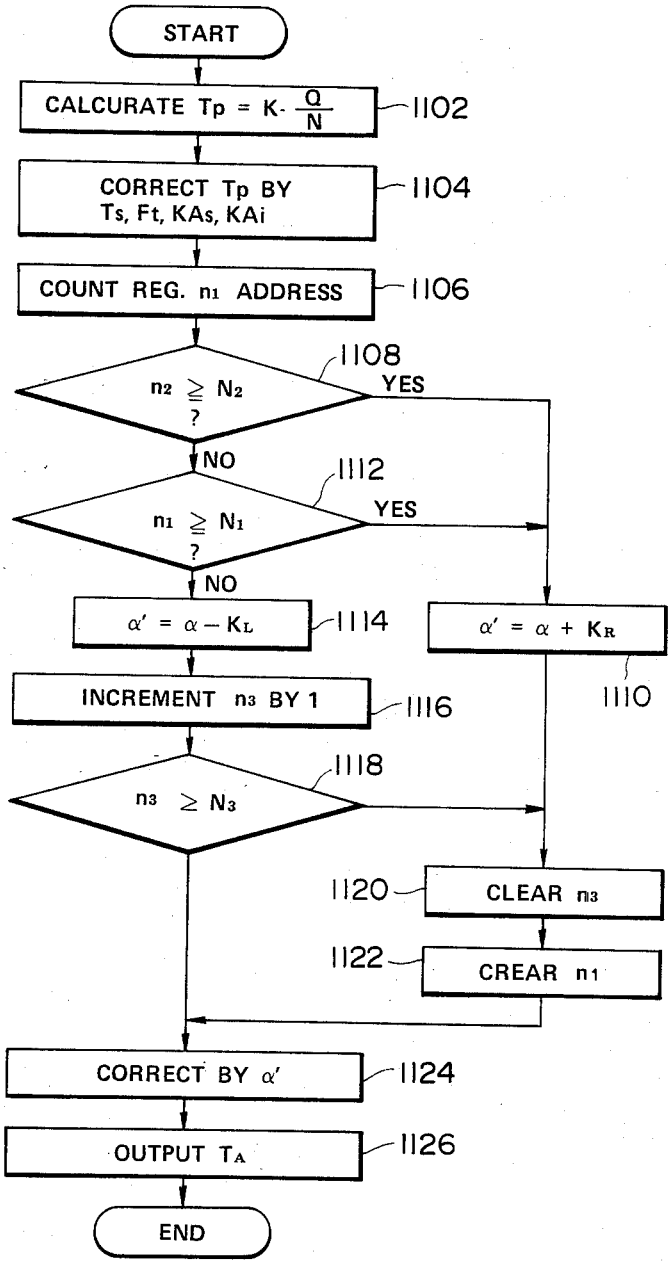
FIG. 26 is a flowchart of a program for determining the fuel injection amount and the fuel injection pulse width.

FIG. 26 is a flowchart of a program for determining a fuel injection pulse $T_A$ having a pulse width determined on the basis of the engine operating condition and taking the engine roughness condition into account. This program of FIG. 26 is executed per every 180° of crankshaft rotation. Therefore, the program of FIG. 26 is executed in response to the crank angle signals indicative of every 180° of crankshaft rotation.

Soon after START, the basic fuel injection amount $T_p$ is determined on the basis of the engine speed signal $S_N$ indicative of the instantaneous engine speed N and the air flow rate signal $S_Q$ indicative of the instantaneous air flow rate or engine load Q, according to the foregoing equation (1), at a block 1102. The basic fuel injection amount $T_p$ is corrected by various correction parameters, such as the battery voltage, the engine coolant temperature and so forth. To make necessary corrections, correction tables 132, 134, 136, 138, 140, 142 and 144 are accessed according to the correction parameters input. This correction is performed at a block 1104.

After the step 1104, the register 150 is checked to obtain the number of cylinders in which unstable combustion has occurred, at a block 1106. The number $n_2$ of the cylinders is compared with a given value $N_2$ at a block 1108. In the shown embodiment, the given value $N_2$ is 2. If the counter number $n_2$ is equal to or greater than the given value $N_2$, the correction value is determined such that fuel injection amount is increased by a given increment ($K_L$) to make the air/fuel mixture richer at a block 1110.

If the counter number $n_2$ is less than the given value $N_2$, then the final value of register value $n_1$ of the current cylinder is read out and compared with a given value $N_1$ at a block 1112. If the net value of the register value $n_1$ is greater than the given value $N_1$, control goes to the step 1110 to determine the correction value for enrichment. In the shown embodiment, the given value $N_1$ is 3.

If the value $n_1$ is smaller than the given value $N_1$, then the correction value is determined so as to decrease the fuel injection amount by a given increment ($K_L$) in order to lean out the air/fuel mixture at a block 1114. After this, a register 156 is incremented by 1 at a block 1116. The value $n_3$ of register 156 is compared to a given value $N_3$, e.g., 24 at a block 1118. If the register value $n_3$ is larger than the given value $N_3$, the register 156 is reset at a block 1120 and the register 150 is cleared at a block 1122. This ensures that the counting operations above will be averaged over a given number, e.g. 4, of engine cycles. Similarly, after determining the correction value for enrichment at the block 1110, the registers 156 and 150 are cleared at blocks 1120 and 1122.

If the register value $n_3$, when checked at the block 1118, is less than the given value $N_3$, then correction of the fuel injection amount by the determined correction value is performed at a block 1124. After the block 1122, control goes to the block 1124 to determine the corrected fuel injection amount based on the determined correction value. Based on the corrected fuel injection amount, the fuel injection pulse width $T_A$ representative of the corrected fuel injection amount is derived at a block 1126. This fuel injection pulse width $T_A$ is transferred and stored in the register 164 of the fuel injection valve driver circuit 160.

It should be appreciated that although the foregoing control system has been illustrated as having only one processor used in common to detect the engine roughness and to generate the fuel injection pulse by time sharing, it would be possible to employ separate processors respectively adapted to determine the engine roughness and the fuel injection pulse. Furthermore, although the foregoing embodiment make the mixture leaner by decreasing the fuel injection amount, it would also be possible to make the mixture rate leaner by increasing an exhaust gas recirculation rate. In this case, a known exhaust gas recirculation control valve (EGR control valve) may be controlled to increase the EGR rate.

Figure 27:
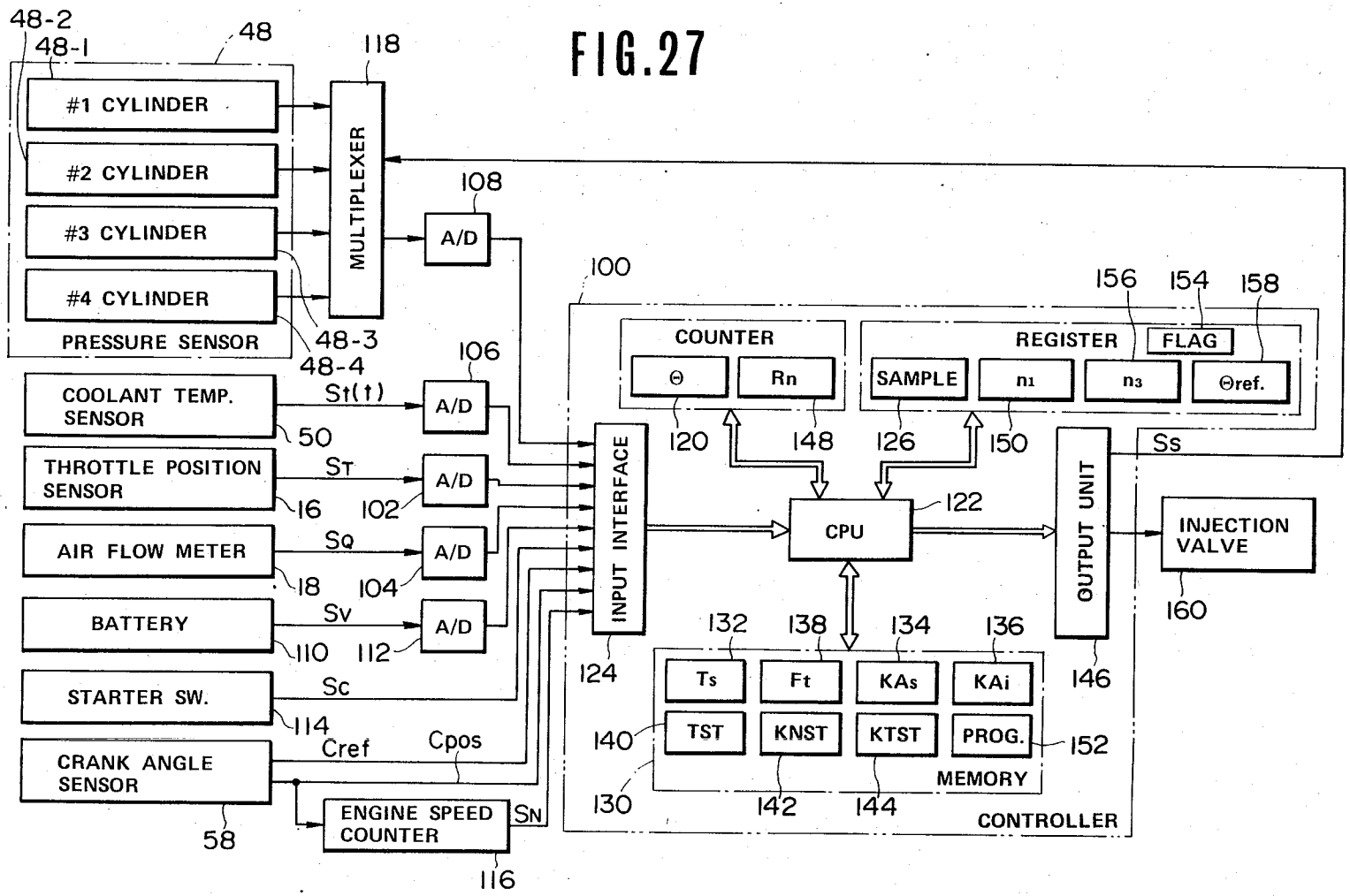
FIG. 27 is a block diagram of a modification of the control system of FIG. 3.
Figure 28:
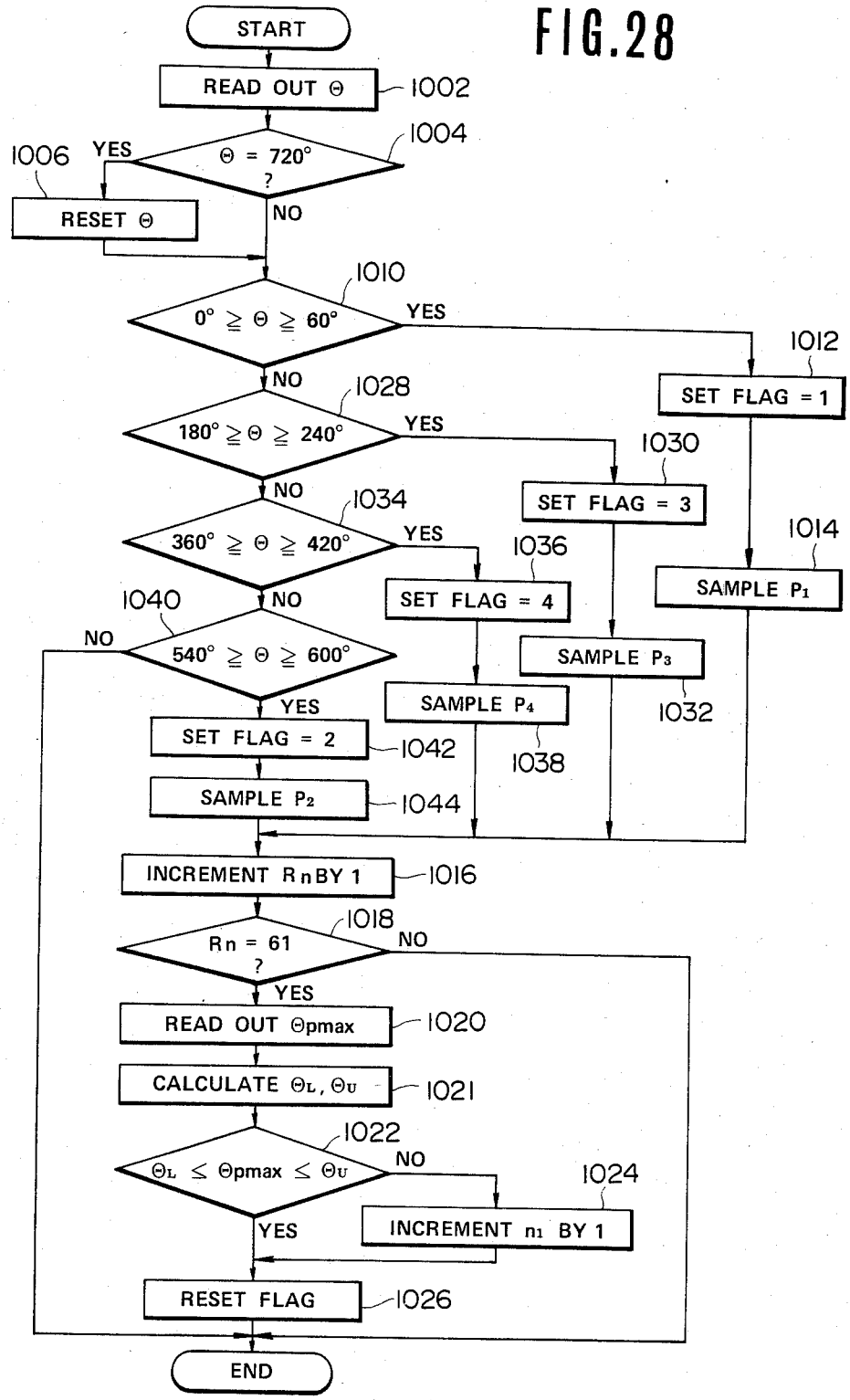
FIG. 28 is a flowchart of a modified program for detecting engine roughness.

A modification of foregoing embodiment of the air/fuel ratio control system has been illustrated in FIGS. 27 and 28. In this modification, the lower and upper thresholds $\theta_L$ and $\theta_U$ are adjusted according to the preceding maximum pressure angles. The thresholds $\theta_L$ and $\theta_U$ are varied in such a manner that an average value $\theta'_{pmax}$ is calculated from preceding maximum pressure angles $\theta_{pmax}$. The oldest maximum pressure angle among four preceding maximum pressure angles is replaced by the instantaneous maximum pressure angle. By averaging to four preceding maximum pressure angles, the average value $\theta'_{pmax}$ is obtained. The lower threshold $\theta_L$ is obtained by subtracting a given value $a_L$ from the average value $\theta'_{pmax}$. On the other hand, the upper threshold $\theta_U$ is obtained by adding a given value $a_U$ for the average value $\theta'_{pmax}$.

To store the four preceding maximum pressure angles $\theta_{pmax}$, a shift-register 158 is provided in the controller 100 as shown in FIG. 27. The shift-register 158 is designed to replace the oldest data with incoming data. For instance, the shift-register 158 receives fresh data during execution of the program of FIG. 28, which data is representative of the instantaneous maximum pressure angle. In response to the fresh data, the oldest among the four last maximum pressure angle values is cleared. Thus, the fresh data is stored in the shift-register 158 as one of the four maximum pressure angle data.

As shown in FIG. 28, after the block 1020 of FIG. 23, a block 1021 is inserted in order to derive the lower and upper thresholds $\theta_L$ and $\theta_U$. In this block, the average value $\theta'_{pmax}$ of the stored four maximum pressure angles is calculated. The given values $a_L$ and $a_U$ are respectively subtracted and added to the average value $\theta'_{pmax}$ to obtain the lower and upper thresholds. At the block 1022, the derived lower and upper thresholds $\theta_L$ and $\theta_U$ are compared with the instantaneous maximum pressure angle $\theta_{pmax}$ to detect engine roughness. If the instantaneous maximum pressure angle $\theta_{pmax}$ is in the range defined by the lower and upper thresholds $\theta_L$ and $\theta_U$, then the program goes to END. On the other hand, if the instantaneous maximum pressure angle is out of the range between the lower and upper thresholds, then the corresponding address of the register 150 is incremented by "1".

As set forth above, according to the present invention, engine roughness is detected by detecting fluctuations in the crankshaft angular position at which the internal pressure in the combustion chamber is maximized each cycle of engine revolution. The air/fuel control system controls the mixture ratio of the air/fuel mixture and makes the latter leaner as long as the cycle-to-cycle fluctuation of the maximum pressure angle is maintained within a predetermined allowable range. When the maximum pressure angle is out of the allowable range, the air/fuel ratio is controlled so as to make the mixture richer. In the shown embodiment, engine roughness out of the allowable range is detected when the number of cylinders in which the maximum pressure angle is out of the allowable range is greater than a given number and/or when the number of occurrences of the maximum pressure angle out of the allowable range is greater than a given number. Accordingly, the air/fuel mixture ratio is controlled to reduce consumption of the fuel due to lean mixture combustion without causing any serious unstability or roughness in the engine.

While the specific embodiment has been illustrated hereabove in order to fully disclose the invention, it is possible to modify or embody the invention otherwise without departing from the gist or content of the invention as defined in the appended claims. For example, in order to detect engine roughness and determine the fuel injection pulse width continuously or sequentially two processor units may be provided. Furthermore, for example, engine roughness may be detected in other ways, for example, by analysis of engine body vibrations or the like. Therefore, it should be appreciated that the present invention should not be understood to be limited to the specific embodiment disclosed hereabove but to include all of the possible embodiments and/or modifications thereof.

What is claimed is:

1. An air/fuel ratio control system for an internal combustion engine having a plurality of engine cylinders comprising:

a first detector for detecting engine operating conditions to produce an engine operating condition indicative signal representative of a basic fuel delivery parameter;

a second detector for detecting cycle-to-cycle fluctuations of the output of each of the engine cylinders to produce a detector signal when the engine fluctuation rate is outside of a given allowable range;

a counter means for counting occurrences of the non-allowable engine fluctuations in each engine cylinder and outputting a first counter signal representative of the number of engine cylinders in which non-allowable engine fluctuations are detected; and a controller unit responsive to said engine operating condition indicative signal for deriving a fuel delivery amount based thereon, and deriving an air/fuel ratio which varies in the direction of a leaner mixture at a first given rate as long as the first counter signal value remains less than a given threshold and in the direction of a richer mixture at a second given rate when the first counter signal value is equal to or greater than said given threshold.

2. The control system as set forth in claim 1, wherein said counter means further counts occurrences of non-acceptable fluctuations in each engine cylinder to output second counter signals, each of which is representative of occurrences of non-allowable fluctuations in a corresponding engine cylinder, and said control unit is responsive to said second counter signals to modify the mixture ratio in the richer direction when one of the second counter signal values is equal to or greater than a given value.

3. The control system as set forth in claim 1, wherein said second detector means is adapted to detect the crankshaft angular position at which a maximum engine output torque is obtained, and has means for comparing said crankshaft angular position with an angular threshold to judge whether said crankshaft angular position is within said allowable range and to produce said detector signal when said crankshaft angular position is outside of said allowable range.

4. The control system as set forth in claim 3, wherein said second detector means comprises a pressure sensor adapted to detect the internal pressure in the engine in order to detect variation of the engine output torque.

5. The control system as set forth in claim 4, wherein said second detector comprises a plurality of pressure sensors respectively adapted to detect variations in the internal presure in each of the engine cylinders.

6. The control system as set forth in claim 5, which further comprises a crank angle sensor adapted to produce a pulse signal after every predetermined increment of crankshaft rotation.

7. The control system as set forth in claim 6, wherein said second detector means is adapted to determine the crankshaft angular position at which a pressure signal value outputted by said pressure sensor is maximized.

8. The control system as set forth in claim 7, wherein said second detector means further comprises a selector means which is adapted to select one of said pressure sensors to transmit the output of the selected pressure sensor in synchronism with the engine revolution.

9. The control system as set forth in claim 8, wherein said selector means selects the one of the pressure sensors which is adapted to mesure the internal pressure in the corresponding engine cylinder which is currently in its combustion stroke to measure the variation of the internal pressure therein.

10. The control system as set forth in claim 9, wherein said second detector means includes a register adapted to sample an instantaneous pressure signal value at each crankshaft rotational angle, said register having storage addresses adapted to store the pressure signal values sampled at each of a plurality of crankshaft angular positions.

11. The control system as set forth in claim 10, wherein said angular threshold includes an upper threshold component and a lower threshold component which cooperatively define said allowable range.

12. The control system as set forth in claim 11, wherein said upper and lower threshold components are derived from an average crankshaft angular position obtained by averaging a predetermined number of previously obtained crankshaft angular positions.

13. An air/fuel ratio control system for a multicylinder internal combustion engine having a plurality of engine cylinders with combustion chambers and an induction system for introducing an air/fuel mixture into each of said combustion chamber, which control system comprising:

a first detector means for detecting engine operating conditions to produce an engine operating condition indicative signal representative of a basic fuel delivery parameter;

a second detector means for detecting engine roughness in each of said engine cylinders during its combustion stroke, and for judging if the detected engine roughness is within a predetermined acceptable range and producing a detector signal when said detected engine roughness is outside of said acceptable range;

a counter means for counting the number of cylinders in which unacceptable engine roughness is detected, said counter means producing an enrichment demand signal when said counted number of cylinders becomes greater than a predetermined first threshold; and a controller unit responsive to said engine operating condition indicative signal to derive a fuel delivery amount based thereon, said control unit controlling the air/fuel ratio of an air/fuel mixture to make the mixture leaner at a given first rate and responsive to said enrichment demand signal to enrich the mixture at a given second rate.

14. The control system as set forth in claim 13, wherein said second detector means is adapted to detect the rate of fluctuation of peak torque in order to detect engine roughness.

15. The control system as set forth in claim 14, wherein said second detector comprises means for detecting an internal pressure in each combustion chamber and means for detecting the crankshaft angular position at which the internal pressure is maximized.

16. The control system as set forth in claim 15, wherein said second detector further comprises means for comparing said detected crankshaft angular position with a predetermined threshold defining said acceptable range of engine roughness and producing said detector signal when said crankshaft angular position is out of said acceptable range.

17. The control system as set forth in claim 13, wherein said counter means also produces said enrichment demand signal when the number of occurrences of engine roughness in any one cylinder exceeds a predetermined second threshold.

18. The control system as set forth in claim 16, wherein said counter means also produces said enrichment demand signal when the number of occurrences of unacceptable engine roughness in any one cylinder exceeds a predetermined second threshold.

19. The control system as set forth in claim 17, wherein said counter means is reset after a given number of cycles of engine revolution.

20. The control system as set forth in claim 18, wherein said predetermined thresholds defining said acceptable range of the engine roughness includes an upper threshold component and a lower threshold component which cooperate to define said acceptable range, and said upper and lower threshold components vary in accordance with engine operating conditions.

21. The control system as set forth in claim 20, wherein said upper and lower threshold components are adjusted by varying their intermediate value which corresponds to the average of said crankshaft angular positions over a given number of preceding engine revolution cycles.

22. The control system as set forth in claim 21, wherein the oldest crankshaft angular position value used to obtain said average crankshaft angular position is replaced by an instantaneous crankshaft position value in each cycle of engine revolution.

23. The control system as set forth in claim 18, wherein said pressure detecting means in said second detector means comprises a plurality of pressure sensors, each of which detects the internal pressure in a corresponding engine cylinder.

24. The control system as set forth in claim 23, wherein said control unit detects the crankshaft angular position in order to select the one of the engine cylinders which is in its combustion stroke and outputs a selector signal indicative of said selected one of the engine cylinders, and said second detector means is responsive to said selector signal to transmit the output signal of the pressure sensor adapted to measure the internal pressure of said selected engine cylinder.

25. The control system as set forth in claim 19, in which said internal combustion engine includes a fuel injection valve, the duty cycle of which is controlled to inject fuel by a fuel injection pulse from said control unit, and said control unit reduces the duration of said fuel injection pulse at said first given rate as long as said enrichment demand signal is absent and increases the duration of the fuel injection pulse at said second given rate in response to said enrichment demand signal.

26. The control system as set forth in claim 22, in which said internal combustion engine has a fuel injection valve opening and closing to control the fuel delivery amount according to a fuel injection pulse having a pulse width corrresponding to the determined fuel delivery amount, and said control unit modifies the fuel delivery amount by reducing the amount as long as said enrichment demand is absent and is responsive to said enrichment demand to modify the fuel delivery amount such that the air/fuel mixture is enriched at said second rate.

27. The control system as set forth in claim 24, which control system is applicable for controlling the air/fuel mixture in a fuel injection internal combustion engine, and said controller unit controls the air/fuel mixture by adjusting the fuel delivery amount depending on the detected engine roughness.

28. A method for controlling an air/fuel ratio for an internal combustion engine comprising the steps of:

detecting engine operating conditions to derive a fuel delivery amount depending thereupon;

detecting engine roughness in each engine cylinder;

judging if the detected engine roughness is within a predetermined acceptable range;

counting occurrences of an unacceptable range of engine roughness in each cylinder;

comparing the number of the engine cylinders in which unacceptable engine roughness is detected within a given duration with a predetermined first threshold; and controlling the air/fuel mixture so as to lean out the mixture at a first given rate as long as the number of cylinders is less than said first threshold and to enrich the mixture at a second given rate when said number of cylinder is greater than said first threshold.

29. The control method as set forth in claim 28, in which said mixture is enriched when the number of occurrences of unacceptable engine roughness in one of the cylinders is greater than a predetermined second threshold.

30. The control method as set forth in claim 29, in which the engine roughness is detected by detecting cycle-to-cycle fluctuations in the output of each engine cylinder.

31. The control method as set forth in claim 29, in which the engine roughness is detected by detecting the crankshaft angular position at which peak torque is obtained.

32. The control method as set forth in claim 29, in which the engine roughness is detected by detecting the crankshaft angular position at which the internal pressure in the engine combustion chamber is maximized.

33. The control method as set forth in claim 32, in which said crankshaft angular position is compared with upper and lower thresholds which define said acceptable engine roughness range to judge that the engine roughness condition is in unacceptable range when the crankshaft angular position is greater than said upper threshold or less than said lower threshold.

34. The control method as set forth in claim 33, in which said upper and lower thresholds are adjusted by varying their intermediate fundamental value which corresponds to the average of a given number of said crankshaft angular positions in the given number of preceding engine revolution cycles.

35. The control method as set forth in claim 34, in which the oldest crankshaft angular position value used to derive the average crankshaft angular position is replaced with an instantaneous crankshaft angular position value in each cycle of engine revolution.

36. The control method as set forth in claim 29, in which the air/fuel ratio is controlled by adjusting the fuel delivery amount by reducing the amount at said first given rate as long as the engine roughness remains within said acceptable range and by increasing the amount at said second given rate when the engine roughness is in said unacceptable range.

37. The control method as set forth in claim 35, in which the air/fuel ratio is controlled by modifying the fuel delivery amount determined on the basis of an engine operating condition other than engine roughness, in such a manner that when the engine roughness remains in said acceptable range, the air/fuel mixture is leaned out at said first given rate, and when the detected engine roughness is in said unacceptable range, the air/fuel mixture is enriched at said second given rate.

38. A control method for controlling an air/fuel mixture to be delivered in a multi-cylinder fuel injection internal combustion engine, comprising the steps of:

detecting engine revolution speed;

detecting the load condition on the engine;

detecting the engine crankshaft angular position;

detecting the internal pressure in each combustion chamber in each of the engine cylinders;

deriving a fuel injection amount based on said engine speed and the engine load to determine a fuel injection pulse width to control the duty cycle of a fuel injection valve in order to inject a controlled amount of fuel into the induction system of the engine;

detecting the peak value of the internal pressure in each cylinder and deriving the crankshaft angular position at the peak pressure;

comparing the derived crankshaft angular position at the peak pressure with upper and lower thresholds;

counting the occurrences of the crankshaft angular position at the peak pressure outside of the range defined by said upper and lower thresholds for each cylinder; and modifying the fuel injection amount by reducing the amount as long as the number of cylinders in which the crankshaft angular position at the peak pressure falls outside of said normal range is less than a given first threshold and the number of occurrences of the crankshaft angular position outside of said normal range in each cylinder is less than a given second threshold, and by increasing the fuel injection amount when the number of cylinders is equal to or greater than said first threshold, or the number of occurrences in each cylinder is equal to or greater than said second threshold.

39. The control method as set forth in claim 38, which further comprises the step of detecting a correction parameter for modifying the fuel injection amount depending upon the value thereof.

40. The control method as set forth in claim 38, which further comprises a step of detecting an instantaneous engine operating condition to identify the engine cylinder in which combustion of the mixture is currently occurring, and selecting the the identified cylinder for measurement of the internal pressure.

41. The control method as set forth in claim 40, in which the internal pressure in the selected cylinder is repeatedly sampled over a given range of rotation of the crankshaft, and the peak value of the internal pressure and the corresponding crankshaft angular position is derived from the sampled values.

42. The control method as set forth in claim 41, in which said counted value is cleared after a predetermined number of cycles of engine revolution.

43. The control method as set forth in claim 42, in which said upper and lower thresholds are adjusted by variation of the average of the crankshaft angular position at the peak pressure over a given number of preceding cycles of engine revolution.

44. The control method as set forth in claim 43, in which said upper threshold is derived by adding a given first constant to said average crankshaft angular position and said lower threshold is derived by subtracting a given second constant from said average crankshaft angular position.

45. A fuel supply control method for an internal combustion engine comprising the steps of:

measuring a number of engine operating parameters including at least the pressure within the engine combustion chambers;

selecting a predetermined basic fuel supply quantity in accordance with the measured operating parameters from a plurality of empirically determined values;

deriving a measure of engine roughness from the measured combustion chamber pressure;

maintaining a count of the number of occurrences of engine roughness;

adjusting the basic fuel supply quantity in accordance with the count of occurrences of engine roughness; and supplying an amount of fuel represented by the adjusted fuel supply quantity to the engine.

46. The method of claim 45, wherein said adjusting step comprises the steps of decreasing the basic fuel supply quantity when the count of occurrences of engine roughness falls within an allowable range, and increasing the basic fuel supply quantity when the count of occurrences of engine roughness falls outside of the acceptable range.

47. The method of claim 46, wherein said measured engine parameters also include crankshaft angular position and said deriving step includes the steps of determining the crankshaft angular position at which the combustion chamber pressure peaks, comparing the determined angular position with a normal range of angular position, and judging that the engine is running roughly when the determined angular position falls outside of the normal range.

48. The method of claim 47, wherein said counting step comprises the step of counting the occurrences of the determined angular position outside of the normal range and the adjusting step is carried out when the number of occurrences exceeds a predetermined number.

49. The method of claim 47, wherein said deriving step is performed for each of the engine combustion chambers, and the counting step comprises counting the number of engine combustion chambers in which said determined angular position falls outside of the normal range and the adjusting step is carried out when said number of combustion chambers exceeds a second predetermined number.

50. The method of claim 47, wherein said normal range of angular position varies with engine conditions, and further comprising the step of determining a lower threshold value and an upper threshold value on the basis of the measured engine parameters, said thresholds defining in conjunction the normal range of angular position.

51. The method of claim 47, wherein said normal range of angular position is from 10° after top dead center to 25° after top dead center in terms of degrees of crankshaft rotation after the top dead center position in the combustion chamber within which pressure is currently being measured.

52. The method of claim 48, wherein said predetermined number of occurrences is three.

53. The method of claim 49, wherein said predetermined number of combustion chambers is equal to half the total number of combustion chambers of the engine.

54. The method of claim 49, wherein said occurrences are counted for a predetermined number of engine revolutions before starting to count again from zero.

* * * * *